US007190337B2

(12) United States Patent
Miller, IV et al.

(10) Patent No.: US 7,190,337 B2
(45) Date of Patent: Mar. 13, 2007

(54) MULTI-CONFIGURATION DISPLAY DRIVER

(75) Inventors: Nick M. Miller, IV, Rootstown, OH (US); Xiao-Yang Huang, Stow, OH (US)

(73) Assignee: Kent Displays Incorporated, Kent, OH (US)

( * ) Notice: Subject to any disclaimer, the term of this patent is extended or adjusted under 35 U.S.C. 154(b) by 0 days.

(21) Appl. No.: 10/782,461

(22) Filed: Feb. 19, 2004

(65) Prior Publication Data

US 2005/0001797 A1 Jan. 6, 2005

Related U.S. Application Data

(60) Provisional application No. 60/484,337, filed on Jul. 2, 2003.

(51) Int. Cl.
*G09G 3/36* (2006.01)

(52) U.S. Cl. ..... 345/87; 345/100

(58) Field of Classification Search ..... 345/80, 345/83, 84, 85, 86, 87, 90–100, 88, 89, 204, 345/205, 211, 214, 215, 690; 315/169.1, 315/169.4

See application file for complete search history.

(56) References Cited

U.S. PATENT DOCUMENTS 5,172,108 A * 12/1992 Wakabayashi et al. ..... 345/691
5,453,863 A 9/1995 West et al.
5,493,430 A 2/1996 Lu et al.
5,523,773 A * 6/1996 Arakawa et al. ..... 345/98
5,530,457 A * 6/1996 Helgeson ..... 345/531
5,815,136 A * 9/1998 Ikeda et al. ..... 345/98
6,034,752 A 3/2000 Khan et al.
6,133,895 A 10/2000 Huang
6,154,190 A * 11/2000 Yang et al. ..... 345/94
6,268,839 B1 7/2001 Yang et al.
6,268,841 B1 * 7/2001 Cairns et al. ..... 345/98
6,278,429 B1 * 8/2001 Ruth et al. ..... 345/94
6,377,321 B1 4/2002 Khan et al.
6,452,590 B1 * 9/2002 Awamoto et al. ..... 345/211
6,483,563 B2 11/2002 Khan et al.
6,532,052 B1 3/2003 Khan et al.
6,628,256 B2 * 9/2003 Nishimura ..... 345/96
6,654,080 B1 11/2003 Khan et al.
6,819,310 B2 11/2004 Huang et al.
6,850,217 B2 2/2005 Huang et al.
7,009,666 B2 3/2006 Khan et al.

(Continued)

FOREIGN PATENT DOCUMENTS

WO 2005/072447 8/2005
WO 2005/072455 8/2005
WO 2005/081779 9/2005

OTHER PUBLICATIONS

*40CH Segment/Driver for Dot Matrix LCD, KS0065B,* Samsung Electronics, 12 pages.

(Continued)

*Primary Examiner*—Nitin Patel
(74) *Attorney, Agent, or Firm*—Pearne & Gordon LLP

(57) ABSTRACT

A modular and configurable display driver for driving a bistable liquid crystal display. The driver has configurable outputs set by a plurality of configuration bits for driving rows or columns of various displays configurations. Thus, the driver can be economically mass produced for use in many products.

44 Claims, 11 Drawing Sheets

U.S. PATENT DOCUMENTS

| | | | | |
|---|---|---|---|---|
| 2001/0015712 | A1* | 8/2001 | Hashimoto | 345/92 |
| 2002/0030776 | A1 | 3/2002 | Khan et al. | |
| 2003/0011549 | A1* | 1/2003 | Murahashi et al. | 345/87 |
| 2003/0085858 | A1* | 5/2003 | Okafuji et al. | 345/87 |
| 2003/0184569 | A1* | 10/2003 | Koga et al. | 345/690 |
| 2005/0001797 | A1 | 1/2005 | Miller, IV et al. | |
| 2005/0083284 | A1 | 4/2005 | Huang et al. | |
| 2005/0162606 | A1 | 7/2005 | Doane et al. | |
| 2005/0195354 | A1 | 9/2005 | Doane et al. | |

OTHER PUBLICATIONS

U.S. Appl. No. 09/378,830, filed Aug. 23, 1999, Khan et al.
U.S. Appl. No. 09/329,587, filed Jun. 10, 1999, Khan et al.
Jing-Jou Tang et al., *A 30-V Row/Column Driver for PSCT LCD Using High-Voltage BiMOS Process,* Online Article, dated 1999.
http://www-us.semidonductors,philips.com/pip/PCF8578T.html. *LCD/row/column driver for dot matrix graphic displays,* printed Jul. 8, 2003, pp. 1-3. pp.

* cited by examiner

MULTI-CONFIGURATION DISPLAY DRIVER

CROSS-REFERENCES TO RELATED APPLICATIONS

This application claims the benefit of provisional application Ser. No. 60/484,337, filed on Jul. 2, 2003, incorporated herein by reference.

FIELD OF THE INVENTION

This application relates generally to a display driver for a display device. More specifically, this application relates to a modular and configurable display driver for driving a bistable display, especially a cholesteric liquid crystal display (LCD).

BACKGROUND OF THE INVENTION

Display driver availability is an important factor of the success of any display technology, especially in relation to the technology feasibility and the long term manufacturing cost. Modular and configurable display drivers that can be mass produced and used in a variety of applications could be cheaply made, making display technology more affordable in more products. In particular, low power LCDs using relatively cheap, configurable display drivers could be used in a variety of portable electronic devices.

Bistable displays that do not require continuous voltage application to maintain their state are becoming particularly important in low power applications. Various technologies can be utilized to provide bistable displays, including (but not limited to): Cholesteric Liquid Crystal Displays (ChLCD); Electrophoretic Displays; Bi-Stable STN Displays; Bi-Stable TN Displays; Zenithal Bi-Stable Displays; Bi-Stable Ferroelectric Displays (FLCD); Anti-Ferroelectric Displays; Interferometric Modulator Display (IMoD); and Gyricon (oil-filled cavity, beads are "bichromal," and charged) displays.

In particular, bistable reflective cholesteric liquid crystal displays (ChLCDs) have been of great interest in the last several years because of their excellent optical properties and low power advantage. Two major drive schemes are known to be available at the time of this disclosure: (1) conventional drive and (2) dynamic drive. Typically, ChLCDs require drive voltages around 40V. High multiplex, off-the shelf (OTS) STN-LCD drivers can accommodate this requirement for a conventional drive. However off-the-shelf drivers for commercially offering dynamic drive ChLCDs would be beneficial.

Driver cost is an issue that is important to the commercial success of a display technology. Using high multiplex STN-LCD drivers benefits ChLCDs with conventional drive significantly in the sense of cost. Leveraging off of the high market volume and the mature technology of STN drivers enables ChLCDs to enjoy volume pricing. However, the practical use of passive matrix STN drivers is limited as a result of the physical response of STN-LCDs; the larger the format of the STN display, the higher the multiplex ratio and the higher the passive matrix driver voltage that is required.

In other words, the STN drive voltage requirements for a passive matrix driver are a direct function of the number of rows to be driven. As such, the 40V STN driver versions used by cholesteric displays are only designed for use in STN displays with formats larger than ¼ VGA (320 columns×240 rows). Because of this coupling of 40V drivers with large display formats, these 40V STN drivers have more than 80 outputs to minimize the assembly cost and display packaging.

In contrast, the drive voltage of ChLCDs is independent of display format. No matter how many rows are to be driven, the drive voltage is fixed at 40V. This presents a problem for small ChLCD modules where many driver outputs are unused from an OTS (Off The Shelf) high multiplex STN driver. For example, a small Ch-LCD module, such as a 32 row by 128 column display requires a 160 output STN row driver and a 160 output STN column driver. In that case, 160 total driver outputs are wasted which increases the total required driver cost. This fact that 40V STN drivers are only available in format larger than 80 outputs can severely affect the market strength of ChLCDs in small formats.

Further, because ChLCDs can be scaled without impacting the required row driver voltages, economies of scalable technologies can be achieved for ChLCDs that may not be possible for STN-LCDs, thus further allowing display driver costs to be reduced.

Current design efforts for a dedicated ChLCD dynamic driver enable consideration for optimization of the driver for the best interest of the technology. This proposed custom driver could be configured simultaneously as a column and row driver. Furthermore, this driver could accommodate both the dynamic and conventional drive schemes. New display drivers directed toward ChLCDs for covering a wide range of display formats providing advantage in high volume and maximum flexibility are thus desirable.

Examples of LCDs that could utilize a driver with one or more of the above benefits include the device disclosed by U.S. Patent Application number 2002/0030776 A1, published on Mar. 14, 2002, which discloses a backlit cholesteric liquid crystal display, and is hereby incorporated by reference in its entirety. U.S. Pat. No. 6,377,321, issued on Nov. 25, 2003, discloses a stacked color liquid crystal display device including a cell wall structure and a chiral nematic liquid crystal material, and is hereby incorporated by reference in its entirety. Further, U.S. Pat. No. 6,532,052, issued on Mar. 11, 2003, discloses a cholesteric liquid crystal display that includes a homogeneous alignment surface effective to provide increased brightness, and is hereby incorporated by reference in its entirety.

SUMMARY OF THE INVENTION

Provided is a display driver comprising a plurality of display outputs each for outputting a drive voltage to a row or a column of a display. The driver also has a plurality of configuration bits each having a row/column setting. Each configuration bit is exclusively associated with one or more of the plurality of display outputs such that the row/column setting of the configuration bit is used to configure all of the associated one or more display outputs for driving either rows or columns of the display.

Also provided is a display driver comprising a plurality of driver blocks, with each of the plurality of driver blocks including a plurality of display outputs each for outputting a drive voltage to a row or column of a display. Each driver block also has a configuration bit having a row/column setting.

Each driver block is configured to drive either rows or columns of the display according to the configuration bit row/column setting, and each of the plurality of display outputs of the driver block is thereby configured to input the drive voltage to either a row or a column of the display, respectively.

Still further provided is a display driver for driving a display, with the display driver comprising a plurality of driver blocks, each driver block including a plurality of display outputs. The display outputs are each for outputting a voltage to a row or a column of a display. Each driver block has a configuration bit having a row/column setting.

All of the plurality of display outputs of the driver block are set to drive either rows or columns of the display according to the configuration bit setting. Further, each of the plurality of driver blocks can be set independently to drive either rows or columns.

Further provided is the above display driver further including a cascade input; and a cascade output.

Two or more of the plurality of driver blocks can be cascaded together for driving additional rows or columns of the display by connecting a cascade input of one of the two or more driver blocks to the cascade output of another of the two or more driver blocks.

Further provided is a display driver comprising: a plurality of display outputs each for outputting a drive voltage to a row or a column of a display; a configuration bit having a row/column setting; a cascade input; and a cascade output.

The row/column setting of the configuration bit is used to configure one or more display outputs for driving either a row or a column of the display. Further, a first display driver can be cascaded with a second display driver by connecting the cascade output of the first display driver with the display output of the second display driver for driving additional rows or columns of the display.

DETAILED DESCRIPTION OF PREFERRED EMBODIMENTS

Multi-Configuration Driver Design

Disclosed herein is a driver that is configurable to function as a row and/or column driver simultaneously. This display driver will be able to operate as a row and/or column driver depending upon the configuration of the output. That is, each output or a group of outputs will have a configuration bit (such as a configurable input or memory setting, for example) representing the operation mode. Expanding upon this concept is a driver with outputs divided into multiple blocks where each block can be configured as row or column driver mode independently. Blocks and/or drivers can be cascaded to increase the number of rows and/or columns being driven.

An R/C lead logic setting, or a bit setting in memory or a register, or a bus input setting can be used to configure the driver or a block portion thereof to operate in a row or column configuration. When set to a row configuration the rows are scanned line by line and the digital row decoder logic is used to determine the voltage output. When set to a column configuration, the driver operates in a column mode by using the digital column decoder logic to determine the voltage output that is applied. That is, the decoder logic for each output of the driver has two modes of operation (row or column) depending upon the configuration setting.

Figure 1:
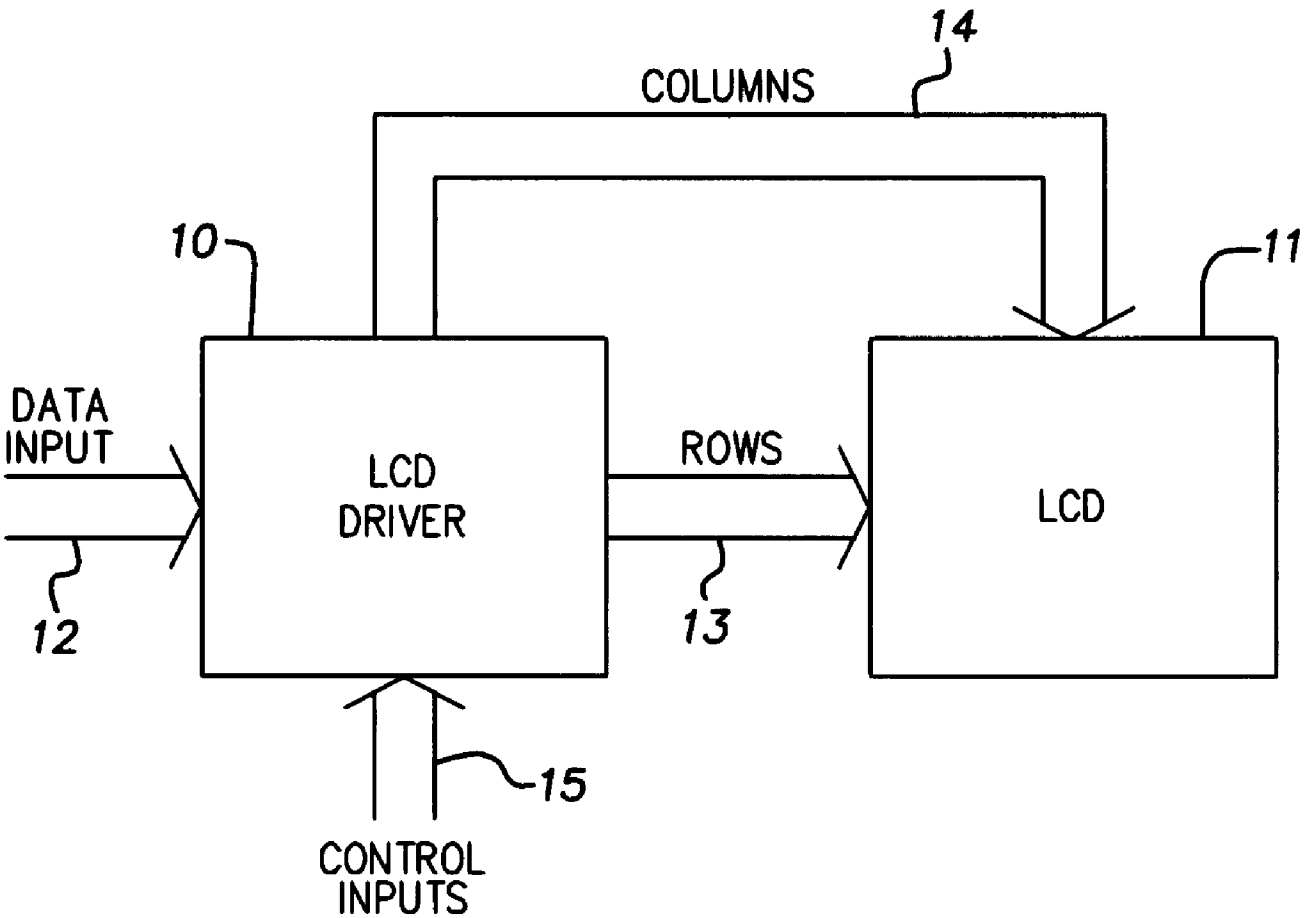
FIG. 1 is a schematic representation of an LCD driver driving both rows and columns of an LCD.

FIG. 1 shows a general schematic of the concept. The driver is contemplated for use with any display technology that can be driven by a driver of the type disclosed herein, especially displays of a bistable type. An LCD is used for illustration purposes as an example display application.

The driver 10 can be used to drive a display 11. The driver can output to rows 13, columns 14, or, as shown in FIG. 1, both rows 13 and columns 14. Data, power, and other inputs are input to the driver 10 via inputs 12. Control inputs 15 configure the driver 10 in the proper manner to drive rows, columns, or, as in this example, both.

Figure 2:
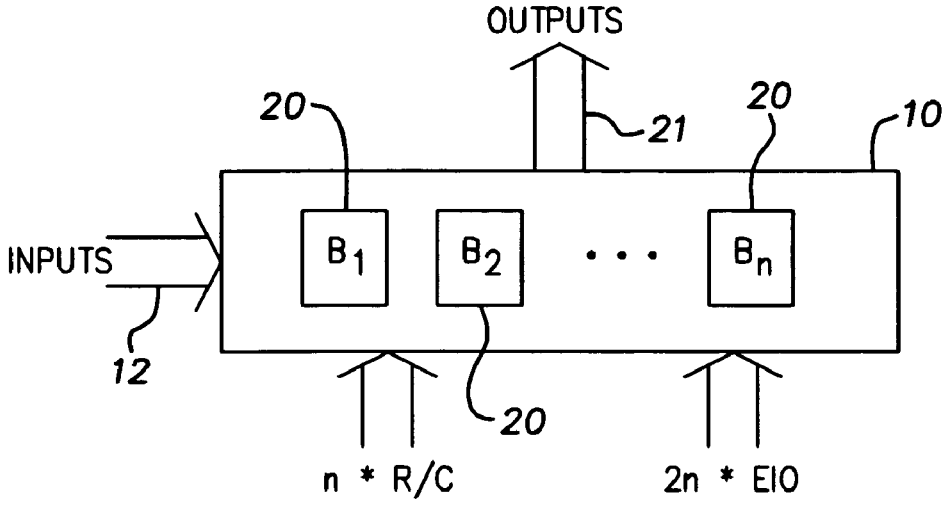
FIG. 2 is a schematic representation of a display driver comprised of individually configurable blocks.

FIG. 2 shows an embodiment of the driver 10 made up of multiple blocks 20. Each block 20 acts as an individually configurable driver block, such that it can be set to drive either rows or columns. Blocks can be operated individually, or cascaded together to drive more display rows or columns than a single block can support, and thus the display outputs 21 can drive a flexible combination of rows and/or columns. Further, blocks from additional drivers can be cascaded together to support even more rows and/or columns. Because each block can be independently configured, the blocks can be arranged to support various displays of different arrangements. Power leads, and other test or monitoring inputs and/or outputs are not individually shown, but are included as part of the inputs 12, which can include Vdd, Vss, Vee, V1~V8, LS, S0, S1, Disp_Off, SCLK, Dir, LP, and data inputs D1~D8, for example. The number of potential columns/rows being supported is virtually unlimited, and can be organized in a complex and/or flexible manner.

Figure 3:
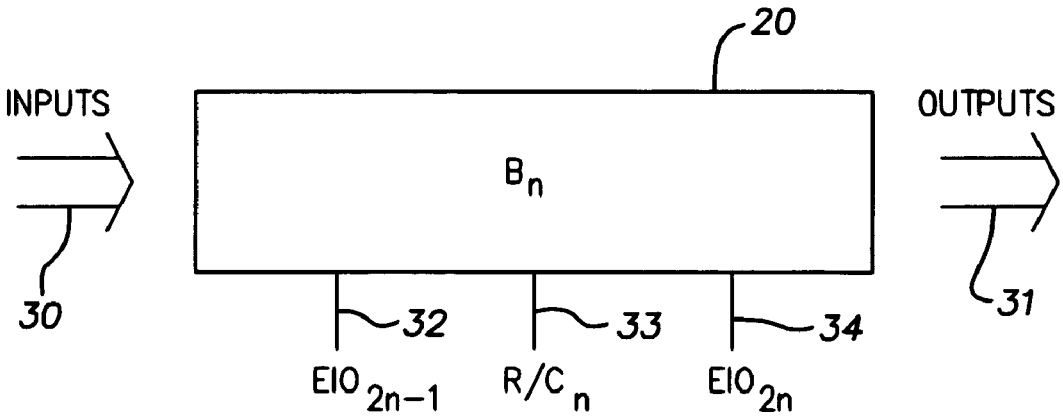
FIG. 3 is a schematic representation of one of the individually configurable blocks of FIG. 2.

FIG. 3 shows a block 20 in detail. Each block 20 has an R/C input 33 which configures the block to drive either a row or a column, depending on a voltage or logic value connected to the R/C input 33. Alternatively, row or column operation may be defined by setting a storage bit in a memory or register in the driver, or provided as a data code as part of the input data or from another data bus, in addition to other implementations. The key is that the block is configured such that its outputs are set to drive either columns or rows of a display, but not both at the same time. However, each block can be independently set, leading to great flexibility. And because there can be a plurality of blocks in each driver, the driver itself can flexibly drive a number of combinations of rows and/or columns.

The Enable Input/Output (EIO) input 32 and EIO output 34 for the block 20 are used for cascading blocks and/or drivers together to allow the display outputs 31 to be uniquely identified and defined, and thus to maintain the order of driving the rows or columns. The EIO input 32 is connected to an EIO output of a prior block/driver in cascade, if any, and the EIO output 34 is connected to the EIO input of the next block/driver in cascade, if any. Unused EIO inputs/outputs may be floating or preferably may be required to be set to some voltage/logic level, such as ground, for performance reasons. Each block will have a certain number of outputs 31 for driving either multiple rows or multiple columns of a display, as desired.

Referring to both FIGS. 2 and 3, if there are n blocks for a driver, there will be n R/C inputs, n EIO inputs, and n EIO outputs (for a total of 2n EIO leads) for configuring the blocks. The number of outputs may be fixed for all blocks, or some blocks may have more outputs than others. Typically, the data inputs 12 are common to all blocks, whereas each block has independent display outputs 31 that, in totality, make up the outputs 21 of the driver.

Figure 4:
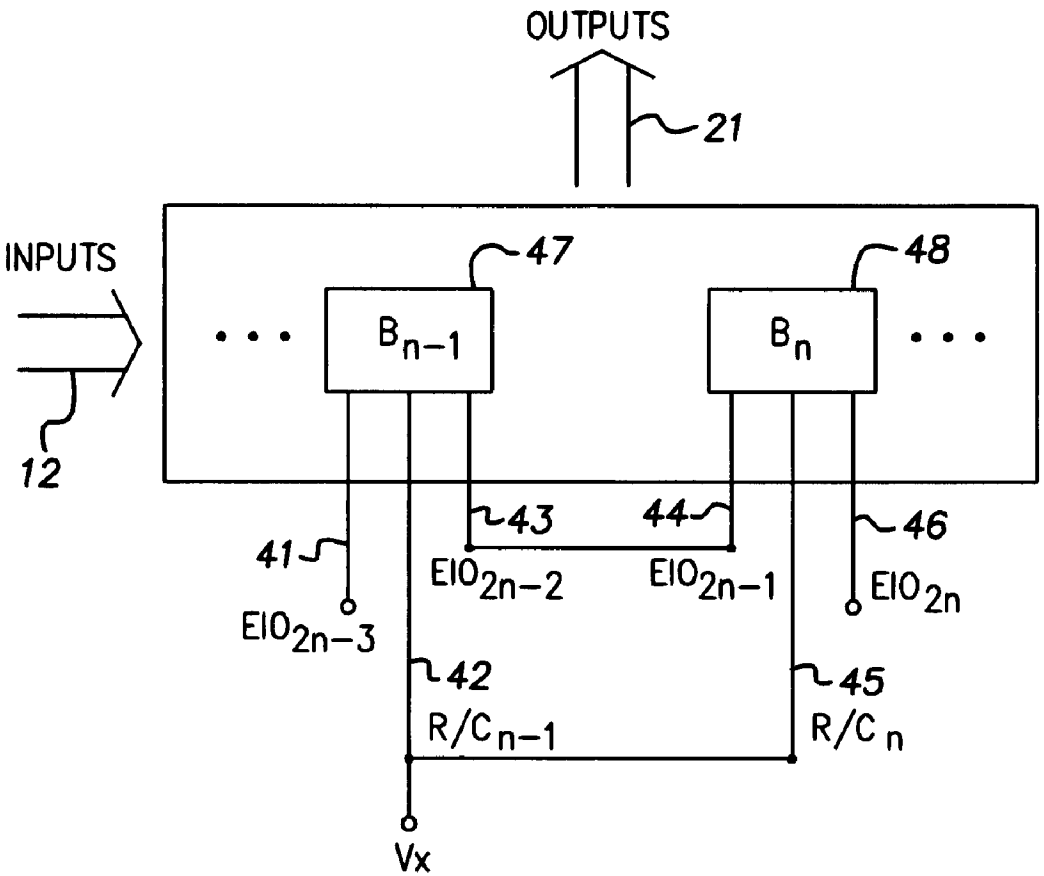
FIG. 4 is a schematic representation of the connections between two cascaded blocks of a display driver.

FIG. 4 shows an arrangement where two blocks 47, 48 in a driver are cascaded together. In this example, both block 47 and block 48 drive either rows or columns of a display. The R/C inputs 42 and 45 are thus connected to a common voltage (logic), defining either row or column operation, thus all outputs of the blocks drive either rows or columns (but not both at the same time). Note that the EIO output 43 of block 47 is connected to the EIO input 44 of block 48. In this manner, blocks 47 and 48 are cascaded together to drive a larger number of rows or columns than a single block could. In addition, the device can be made user configurable to provide a settable output voltage to support different LCDs devices.

Typically, the EIO and R/C connections are hardwired during construction of the driver apparatus using the driver for a particular display, although it would certainly be within the scope of the invention to make their configuration variable, such that a driver could be user or factory configurable, thus allowing multiple display formats to be utilized, such as for upgrading displays, for example. Further, such configurations could be set via software, hardware, etc. if desired.

The following three driver designs are offered as examples of preferred embodiments of this invention:

64-Output 100-Pin Quad Flat Pack (QFP)

Figure 5:
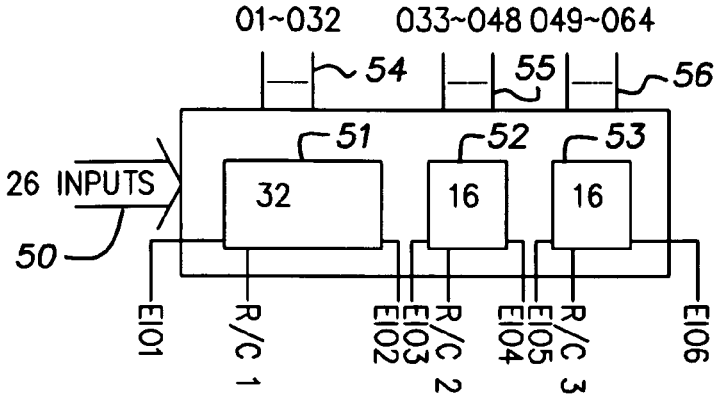
FIG. 5 is a schematic representation of one embodiment of a display driver having configurable blocks.

FIG. 5 shows an example embodiment with a reduced package format. This embodiment can be packaged as a 26-input, 64-output, 100 pin QFP package. The 64 outputs can be divided into one block 51 of 32 outputs display 54, and two blocks 52, 53 of 16 display outputs 55, 56. There are preferably 26 common inputs 50. The resulting total pin count is 99, which can utilize a 100 pin QPF.

This driver design can be configured so that the entire chip becomes a dedicated row or column driver by connecting EIO2 output to EIO3 input, EIO4 output to EIO5 input, and connecting R/C1, R/C2, and R/C3 together (and to a common logic voltage). Such an arrangement, by cascading multiple drivers in various arrangements, can be used to drive displays of at least the following formats:

64 row by 64 column;
64 row×128 column;
160 row×240 column;
240 row×320 column; and
480 row×640 column By properly configuring the EIOs and R/Cs separately by block, the driver can also be configured to drive displays of at least the following formats:

16 row×48 column;
32 row×32 column; and
48 row×16 column.

By adding extra drivers in row or column mode, additional display formats can be supported, such as 16 row×112 column, and 32 row×96 column, for example. Additional configurations are possible through other arrangements.

Figure 6:
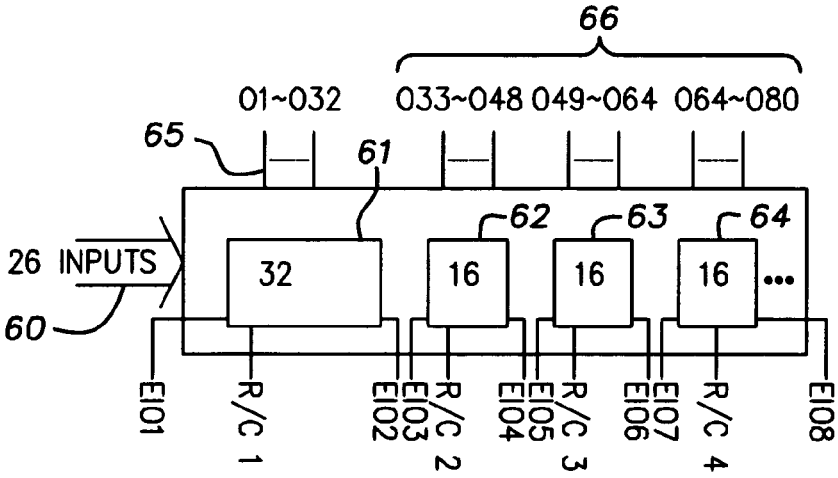
FIG. 6 is a schematic representation of another embodiment of a display driver having configurable blocks.

In general, independent data shift direction logic (Dir) can be assigned to each block based on the optimal cost and application requirement. 80-output 120-pin QFP As shown in the example of FIG. 6, the driver has 26 common inputs 60, as discussed for previous embodiments. The 80 display outputs 65, 66 are divided into 4 blocks, one of 32 outputs 65, and three of 16 outputs each 66.

For each of the 4 blocks, there is an independent set of R/C inputs and an EIO input and output lead. Depending on the logic (voltage) level of R/C pins (or bits), the block can be set in either the row or the column mode. Therefore, the device is a 118 pin driver which can be packaged in 120-pin QFP format. A Dir input can be added to each block to make the data shift direction independent among blocks. However, this will make the package be more than 120 total pins which would likely cost more.

The example embodiment shown in FIG. 6 can be configured with combinations for various display formats. This driver can be configured as an all row or all column driver by electrically connecting all R/Cs together and connecting EIO2 output to EIO3 input, EIO4 output to EIO5 input, and EIO6 output to EIO7 input. In this way, the driver can support large format displays such as ⅛VGA (240 column×160 row), ¼VGA (320 column×240 row) and VGA (640-column×480 row).

By configuring the EIOs and R/C's independently, a single driver can support 16 row×64 column, 32 row×48 column, 48 row×32 column, and 64 row×16 column. By adding another driver in the column mode, additional configurations include 16 row×144 column, 32 row×128 column, 48 row×112 column, etc. These are just a limited list of the possible combinations this driver can provide by configuring the blocks and/or additional drivers in various manners.

It will be noted that other embodiments can utilize different configurations of blocks, such as blocks with various numbers of output leads. Such configurations depend on the types of displays to be supported. It is believed that the embodiments of FIGS. 5 and 6 provide significant flexibility, allowing the driver to be utilized for various commonly used display configurations. However, the invention is not limited to these embodiments. Blocks of 2, 4, 8, or other combinations of leads can be utilized. Further, all blocks could utilize the same number of leads, or various combinations of numbers of leads, as needed for the desired application and/or for the desired flexibility.

160-Output Tape Carrier Package (TCP)

Figure 7:
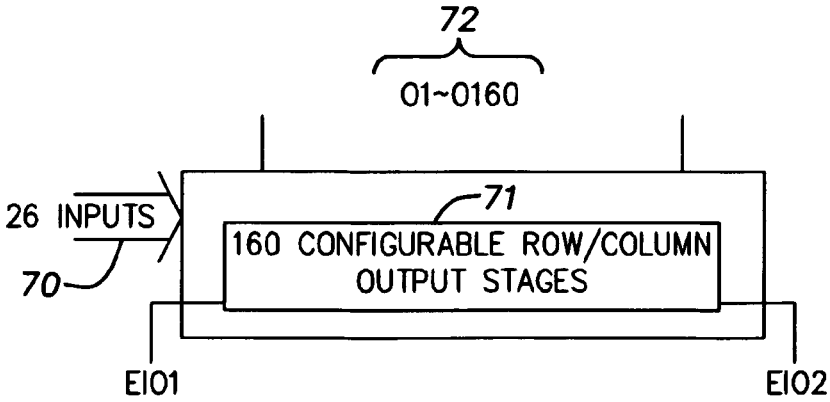
FIG. 7 is a schematic representation of an embodiment of a display driver having individually configurable outputs.

To provide maximum flexibility, a commercially available 160 output TCP package is also provided as an example, as shown in FIG. 7. For this embodiment, the configuration of blocks of outputs is replaced with individual configuration for each individual display output O1-O160 of the display outputs 72. Thus, each output is selectable to function in a row mode or in column mode. However, it is clear that a separate R/C lead for each output is not feasible for such large numbers of outputs. Nevertheless, the actual implementation can be performed in at least a few different ways, avoiding the need of using inputs 70 to set the output to row or column usage. For example, a data bus into the driver can be expanded to include a configuration data item or bit in addition to the voltage information to set the output configuration for each lead.

Alternatively, the driver could have a separate configuration register or memory where the output mode for each output could be stored. A single bit per lead could be used, for example. An advantage of this implementation is that the configuration information would not have to be repeatedly shifted into the device as long as power was maintained to this register memory portion. Using an EEPROM, or some other ROM type memory, could preserve the settings at a power loss.

With the driver design of FIG. 7, or some design utilizing some other number of driver outputs, the driver can be configured for any combination of rows and columns (160 pin package is chosen as an example because it is an accepted industry standard; other numbers of pins are easily accommodated in like fashion). As with the other examples, this driver could also function completely as a column or row driver for large format displays. Further, this driver can be cascaded using the EIO input/output leads, as described for the other embodiments above, allowing even greater flexibility to support a virtually unlimited number of output leads. Further, by combining combinations of the different embodiments, further flexibility could be provided.

Figure 8:
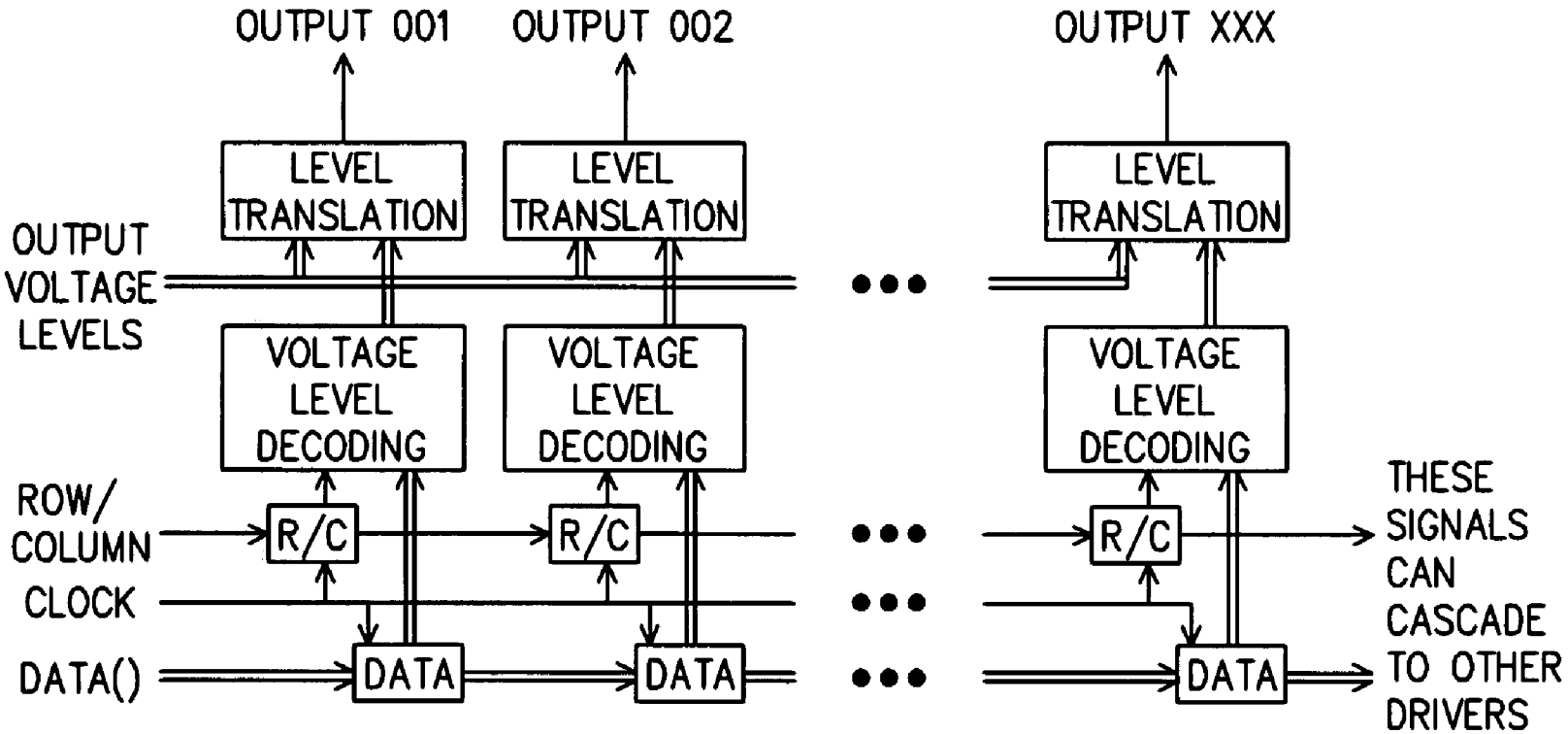
FIG. 8 is a more detailed schematic representation of the internal configuration of a display driver or a configurable block.

FIG. 8 provides a schematic of one possible implementation of circuitry for implementing the driver, provided as an example.

Figure 9:
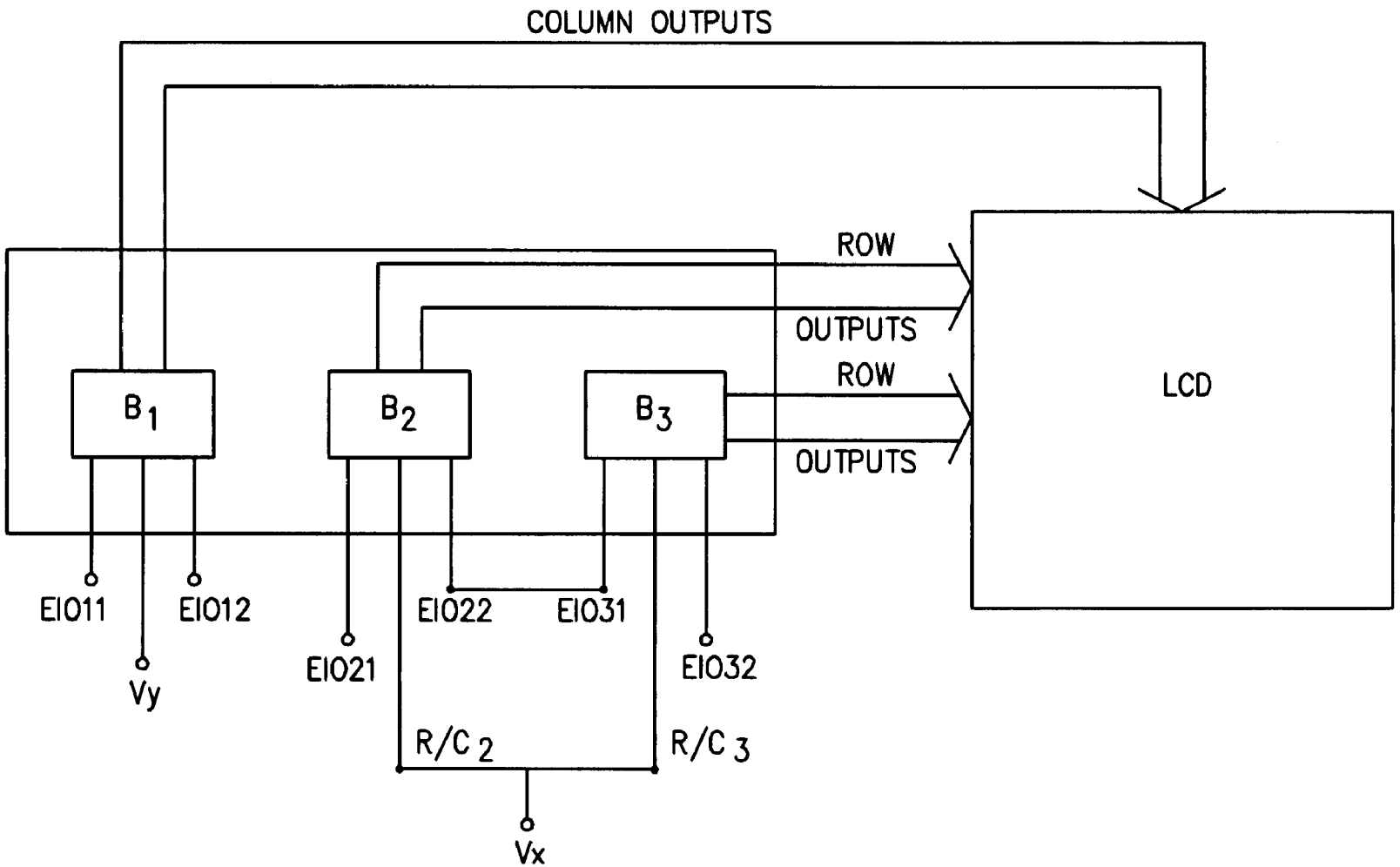
FIG. 9 is a schematic representation of the embodiment of FIG. 5 driving both the rows and columns of a display.

FIG. 9 shows one possible use of the embodiment of FIG. 5 to drive a display of 32 rows and 32 columns, showing an example of how the driver would be configured. $V_y$ is the voltage/logic setting for column operation and $V_x$ is the voltage/logic setting for row operation. Note that because blocks $B_2$ and $B_3$ are cascaded together to drive rows, the output EIO lead of $B_2$ is connected to the input EIO lead of $B_3$.

Figure 10:
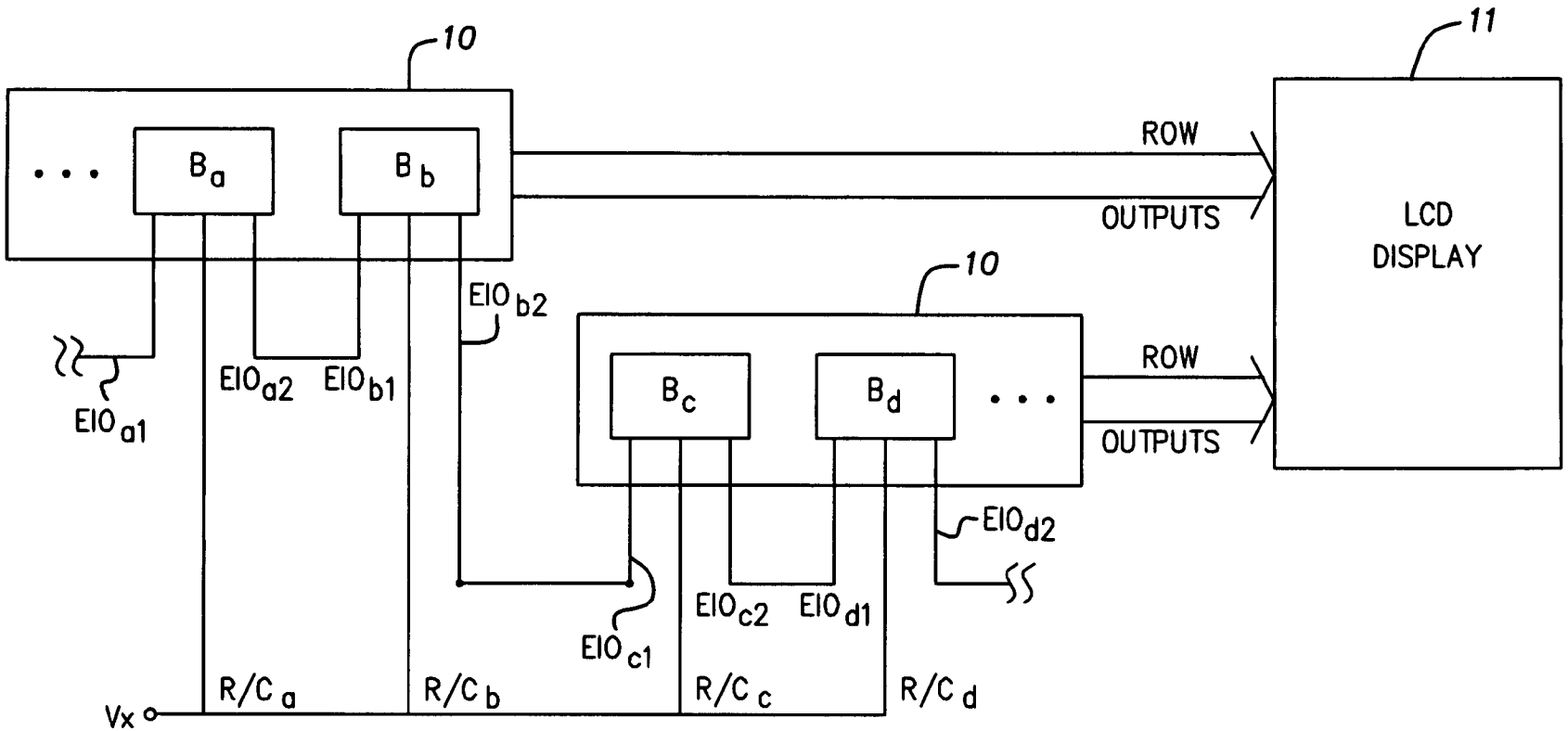
FIG. 10 is a schematic representation of an embodiment of a two display drivers having configurable blocks being cascaded together to drive rows of a display.

FIG. 10 is a further example of cascading blocks, where two drivers are cascaded together in order to drive a larger number of rows. In a similar manner, drivers and/or blocks can be cascaded to drive more rows, or to drive columns. Thus, the driver design provides great flexibility for supporting a large number of display configurations.

It will be understood that the above embodiments can be modified in various manners to obtain additional driver designs using different numbers of blocks, outputs, inputs, etc. The choice of design depends on the applications and the market conditions, or the desired packaging implementation. The overall concept is greatly flexible, as is shown by the examples.

As discussed above, a potential advantage of this multi-configurable driver is increased volume and flexibility. In addition, this invention allows one driver to support an entire product line of bistable display formats, which is not possible with current passive matrix STN-LCD drivers because their drive voltage changes with the display size. A driver design accommodating many display formats can significantly reduce the driver cost in the silicon fabrication, packaging, and supporting infrastructure.

In particular, this invention can be utilized for ChLCDs, and for any display technology that has a switching threshold voltage and is bi-stable. These are most easily supported because other common display technologies (such as STN and TN) have voltage requirements that are a function of the display multiplexing (multi-plex ratio). For these technologies to overcome these voltage thresholds, the internal driver structure voltage must change as a function of the number of rows in the display. For bi-stable devices this is not the case; the voltage structure is independent of the number of rows in the display. Such a driver can also lend great support to emerging technologies by allowing them to compete with existing high volume technologies by utilizing one driver design to cover multiple display formats.

Thus, the current design can be most beneficially utilized in applications where the row drive voltage does not change dependent on the number of rows being driven. However, the design might also be utilized in other applications where maximum row/column driver flexibility is desired, including current STN-LCDs, by varying the row driving voltages in some manner, if necessary.

In particular, the driver is useful for driving bistable liquid crystal displays having chiral nematic liquid crystal material between substrates, wherein at least one of the substrates cooperates with an alignment surface and said liquid crystal material so as to form focal conic and planar textures that are stable in the absence of an electric field.

By tailoring the driver for use with various state-of-the-art displays, in particular bistable displays such as chiral nematic LCDs, for example, a flexible, versatile display device can be provided at reasonable costs.

For example, the display driver can be used to drive a liquid crystal display utilizing a stacked layer design disclosed in U.S. Pat. No. 6,377,321, incorporated herein in its entirety. That display is addressed by applying an electric field having a preferably square wave pulse of a desired width can be supported. The voltage that is used is preferably an AC voltage having a frequency that may range from about 125 Hz to about 2 kHz. Various pulse widths may be used, such as a pulse width ranging from about 6 ms to about 50 ms. The display may utilize the addressing techniques described in the U.S. Pat. No. 5,453,863 (incorporated herein by reference in its entirety) to effect grey scale.

This display, for example, may utilize ambient visible and infrared radiation or an illumination source on the display or on the night vision goggles. The radiation incident upon typical cholesteric displays has components that correspond to the peak wavelength of the display. One way to illuminate a cell to reflect infrared radiation is to shine infrared radiation upon the display. In military applications, such as for use on instrumentation in the cockpit of a military helicopter, for example, the illuminating radiation may be infrared only, which preserves the darkness of the cockpit. It may also be possible to utilize the infrared content of the night sky derived in part from the moon and the stars. The infrared radiation of the night sky may even be sufficient on an overcast night because the infrared radiation may filter through the clouds.

An example of a single cell display is shown in U.S. Pat. No. 5,453,863, entitled Multistable Chiral Nematic Displays, which is incorporated herein by reference in its entirety. The spacing between the substrates of the single cell display may range from about 4 microns to about 10 microns.

Figure 11:
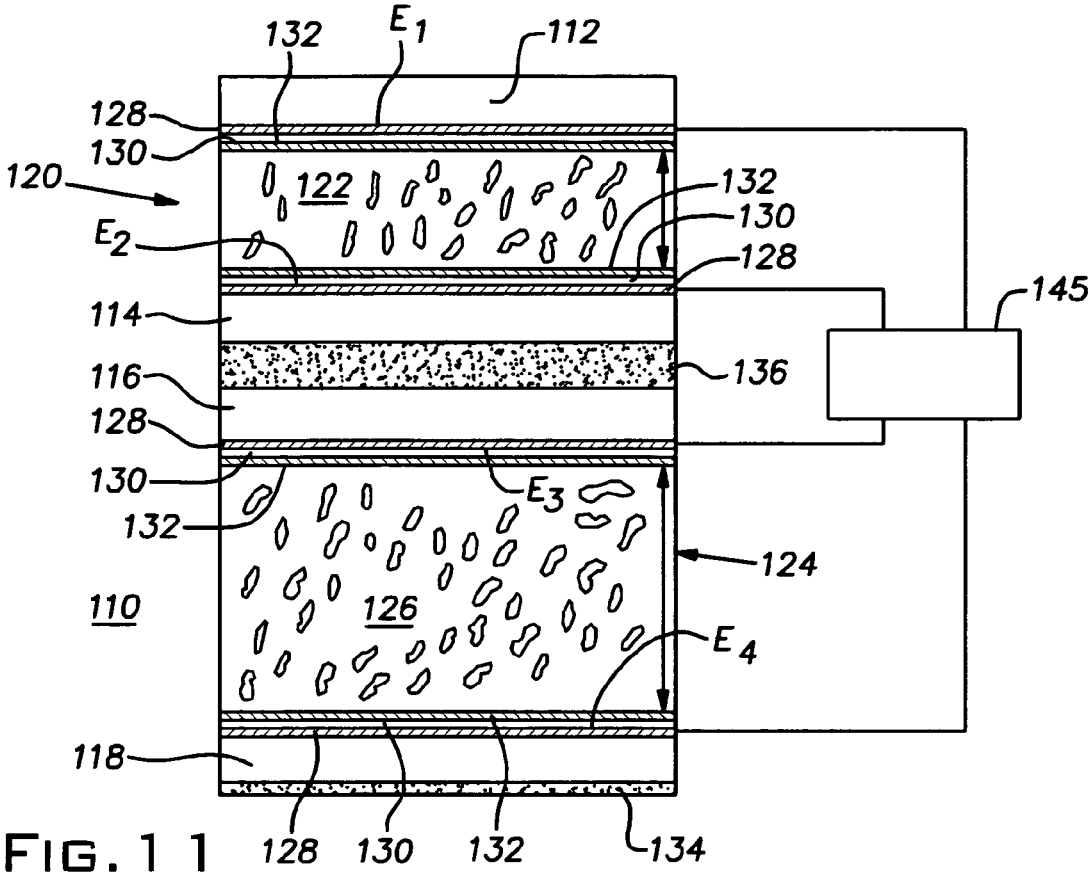
FIG. 11 is a schematic representation of a stacked display employing four substrates and a cell that reflects visible light and a cell that reflects infrared radiation.

One example of a display having two stacked cells is shown generally at 110 in FIG. 11. This particular display employs four glass substrates 112, 114, 116 and 118. One cell 120 includes a first chiral nematic liquid crystal material 122 disposed between the opposing substrates 112 and 114. The substrate 112 is nearest an observer. Another cell 124 on which the cell 120 is stacked includes a second chiral nematic liquid crystal disposed between the opposing substrates 116 and 118.

The first liquid crystal 122 includes a concentration of chiral material that provides a pitch length effective to enable the material to reflect visible light. The second liquid crystal 126 includes a concentration of chiral material that provides the material with a pitch length effective to enable the material to reflect infrared radiation.

The substrates 112, 114, 116 and 118 each have a patterned electrode such as indium tin oxide (ITO), a passivation material and an alignment layer 128, 130, 132, respectively. The back or outside of the substrate 118 is coated with black paint 134. The purpose of the ITO electrode, passivation material and alignment layer will be explained hereafter.

An index of refraction-matching material 136 is disposed between the substrates 114 and 116. This material may be an adhesive, a pressure sensitive material, a thermoplastic material or an index matching fluid. The adhesive may be Norland 65 by Norland Optical Adhesives. The thermoplastic material may be a thermoplastic adhesive such as an adhesive known as Meltmount, by R.P. Cargile Laboratories, Inc. This thermoplastic adhesive may have an index of refraction of about 1.66. The index matching fluid may be glycerol, for example. When an index matching fluid is used, an independent method of adhering the two cells together is employed. Since both textures of the second cell are transparent to visible light, the stacking of the cells does not require accurate alignment or registration of the two cells. The spacing between the substrates 112 and 114 of the first cell ranges from about 4 to about 6 microns. The spacing between the substrates 116 and 118 of the second cell ranges from about 4 to about 10 microns and greater.

The driver circuitry 145 is electrically coupled to four electrode arrays E1, E2, E3 and E4, which allow the textures of regions of the liquid crystal display to be individually controlled. The application of a voltage across the liquid crystal material is used to adjust the texture of a picture element. The electrode matrix E1 is made up of multiple spaced apart conductive electrodes all oriented parallel to each other and all individually addressable by the driver electronics 145. The electrode array E2 spaced on the opposite side of the liquid crystal material 122 has an electrode array of spaced apart parallel electrodes. These electrodes are arranged at right angles to the electrodes of the matrix E1. In a similar manner the matrix array E3 has elongated individual electrodes at right angles to the elongated individual electrodes of the matrix array E4.

Figure 12:
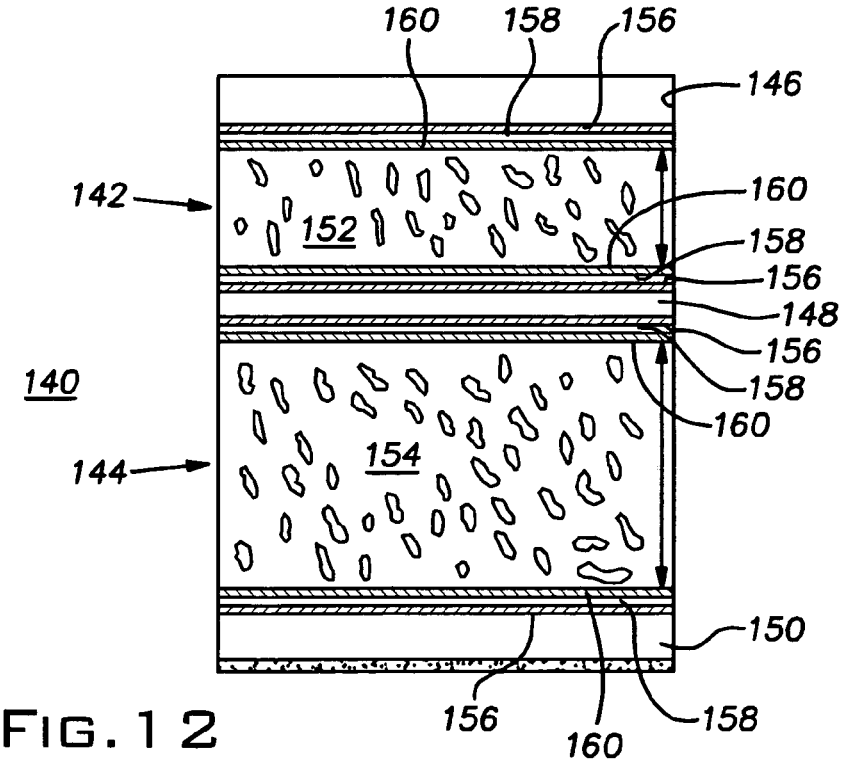
FIG. 12 is a schematic representation of a stacked display employing three substrates and a cell that reflects visible light and a cell that reflects infrared radiation.

Another stacked cell display is generally shown as 140 in FIG. 12. This display 140 includes a visible cell 142 and an infrared cell 144 and includes substrates 146, 148 and 150. A third chiral nematic liquid crystal 152 is disposed between the substrates 146 and 148 of the visible cell. The substrate 46 is nearest the observer. A fourth chiral nematic material 154 is disposed between the substrates 148 and 150 of the infrared cell.

The third liquid crystal has a concentration of chiral additive that provides it with a pitch length effective to reflect visible light. The fourth liquid crystal material has a pitch length effective to reflect infrared radiation.

The spacing between the substrates 146 and 148 of the visible cell ranges from about 4 to about 6 microns. The spacing between the substrates 148 and 150 of the infrared cell ranges from about 4 to about 10 microns and greater.

The third and fourth liquid crystal materials may be the same or different than the first and second liquid crystal materials. The visible cell 142 is preferably disposed downstream of the infrared cell in the direction from the infrared cell toward the observer. No index matching material needs to be used in the three substrate stacked display.

In the three substrate display shown in FIG. 12, the middle substrate 148 is disposed between the substrates 146 and 150 and is in common with the visible and infrared cells. The middle substrate 148 acts as the back substrate of the visible cell and the front substrate of the infrared cell. The common substrate 148 has conductive, passivation, and alignment layers 156, 158 and 160, respectively, coated on both sides. By passivation layer is meant an insulating layer that prevents front to back shorting of the electrodes. The substrates 146 and 150 have patterned electrode, passivation, and alignment layers 156, 158 and 160 coated on only one side.

Figure 15:
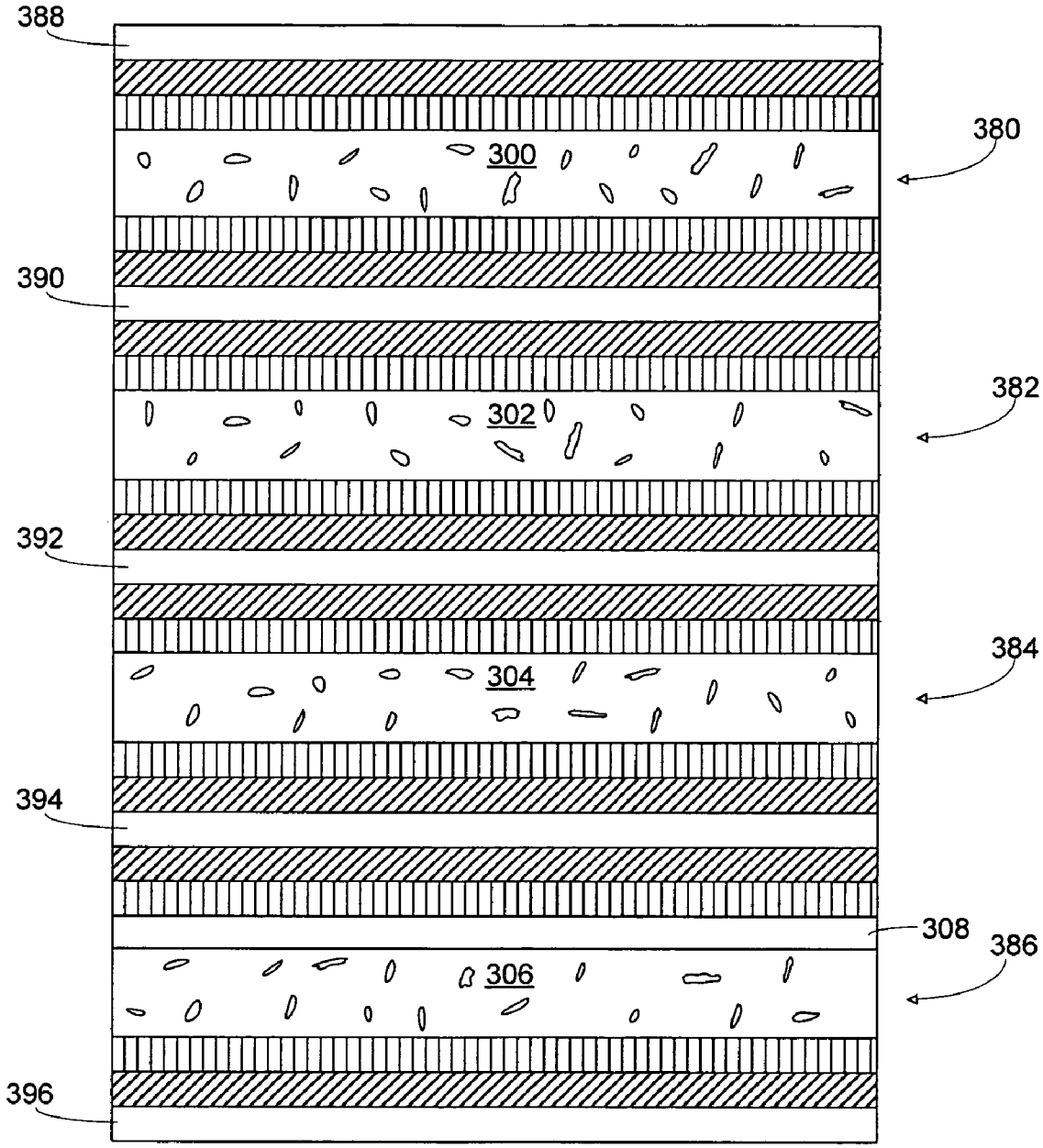
FIG. 15 is a schematic representation of a stacked display having multicolor capabilities including at least three cells that reflect visible light and a that reflects infrared radiation.

The stacked display may also be fabricated to reflect multiple colors. In this regard, two, three or more cells that reflect visible light may be used. FIG. 15 shows one example of a stacked multi-color display. First, second and third visible reflecting cells 380, 382 and 384 are stacked in series in front of an infrared reflecting cell 386. The display includes substrates 388, 390, 392, 394 and 396. Substrate 388 is disposed closest to an observer at the front of the cell and the substrate 396 is disposed at the back of the display. First, second and third chiral nematic liquid crystal materials 300, 302 and 304 have a pitch length effective to reflect visible light. Liquid crystal material 306 has a pitch length effective to reflect infrared radiation.

This particular display employs substrates having electrodes on both sides, prepared according to the photolithography method of the present invention. However, the arrangement shown in FIG. 11 may be employed as well, in which case eight substrates may be used. Index matching material would then be employed between adjacent substrates. Passivation and alignment layers are also disposed on the substrates.

Each of the liquid crystals 300, 302 and 304 has a concentration of chiral additive that produces a pitch length effective to reflect a different wavelength of visible light than the others. The liquid crystal compositions may be designed to reflect light of any wavelength. For example, the first cell 380 may reflect red light, the second cell 382 may reflect blue light and the third cell 384 may reflect green light. In addition, to achieve a brighter stacked cell display, the liquid crystal in one cell may have a different twist sense than the liquid crystal of an adjacent cell for infrared/visible displays and color displays. For example, in a three cell stacked display, the top and bottom cells may have a right handed twist sense and the middle cell may have a left handed twist sense.

The back substrate of each cell may be painted a particular color or a separate color imparting layer 308 may be used. Examples of color imparting layers suitable for use in the present invention are provided in U.S. Pat. No. 5,493,430, entitled "Color, Reflective Liquid Crystal Displays," which is incorporated herein by reference in its entirety. The back substrate of the visible cell that is furthest from the observer may be painted black or a separate black layer may be used to improve contrast, replacing layer 308.

The bistable chiral nematic liquid crystal material may have either or both of the focal conic and twisted planar textures present in the cell in the absence of an electric field. In a pixel that is in the reflective planar state, incident light is reflected by the liquid crystal at a color determined by the selected pitch length of that cell. If a color layer or "backplate" 308 is disposed at the back of that cell, light that is reflected by the pixel of that cell in the reflective planar state will be additive of the color of the liquid crystal and the color of the backplate. For example, a blue reflecting liquid crystal having an orange backplate will result in a generally white light reflected from the pixel in the reflective planar state. A pixel of the cell that is in the generally transparent focal conic state will reflect the orange color of the backplate to produce a white on orange, orange on white display. If a black layer is used at the back of the cell, rather than a colored backplate, the only color reflected will be that of the planar texture of the liquid crystal, since the black layer absorbs much of the other light. The color imparting layers of the visible cells and the black layer at the back substrate of the last visible cell are transparent so to enable light to travel to the next cell.

In the case of two or more cells, some incident light is reflected by the planar texture of the first cell at a particular color. Two or even three of the cells may be electrically addressed so as to have their liquid crystal transformed into the reflecting planar state, in which case the color reflected from the display would be produced by additive color mixing. Since not all of the incident light is reflected by the liquid crystal of the first cell, some light travels to the second cell where it is reflected by the planar texture of the second cell. Light that travels through the second cell is reflected by the planar texture of the third cell at a particular color. The color reflected by the first, second and third cells is additively mixed. The invention can reflect the colors of selected cells by only transforming the particular cell into the reflecting planar texture, the other cells being in the focal conic state. In this case, the resultant color may be monochrome.

Moreover, by utilizing grey scale by a process such as that disclosed in the U.S. Pat. No. 5,453,863, one or more cells of the display may be made to reflect light having any wavelength at various intensities. Thus, a full color display may be produced. The display may also be made to operate based upon principles of subtractive color mixing using a backlighting mode. The final color that is produced by various combinations of colors from each liquid crystal material, different colored backplates, and the use of grey scale, can be empirically determined through observation. The entire cell may be addressed, or the cell may be patterned with electrodes to form an array of pixels, as would be appreciated by those skilled in the art in view of this disclosure. The driver electronics for this display would be apparent to those skilled in the art in view of this disclosure.

The spacing between substrates of the visible cells of FIG. 15 is uniform. However, the visible cell spacing may be adjusted as desired. For example, a cell that reflects blue light employs a relatively small pitch length. Therefore, the cell spacing needed to accommodate enough pitches for suitable reflectance may be decreased. As a result, the cell may have a smaller spacing, which enables the cell to be driven at a lower voltage than the cells having a larger spacing.

Two, three or more visible cells may be employed in conjunction with the infrared cell, as shown in FIG. 15. Alternatively, a display may include two, three or more visible cells without an infrared cell. The design of such a display may be similar to that shown in FIG. 11, except that the infrared cell would be replaced by a cell that reflects visible light. The liquid crystal composition, composition of additives, cell fabrication and operation of such a stacked multiple color, visible cell display would be apparent to those skilled in the art in view of this disclosure.

Further, the driver can be utilized with backlit displays, such as is discussed in U.S. Application No. 2002/0030776, published on Mar. 14, 2002, incorporated herein by reference in its entirety. Such a chiral nematic liquid crystal display may be operated in both a reflective mode and a transmissive mode. The display includes a chiral nematic liquid crystal material located between first and second substrates, an ambidextrous or bi-directional circular polarizer, a partial mirror, also referred to as a transflector and a light source. A partial mirror or transflector reflects a portion of light incident on the partial mirror or transflector and transmits the remaining portion. The chiral nematic liquid crystal material includes focal conic and planar textures that are stable in the absence of an electric field. The ambidextrous circular polarizer is located adjacent to one of the substrates that bound the liquid crystal material.

The chiral nematic liquid crystal material has a circular polarization of a predetermined handedness, for example left handedness. The ambidextrous circular polarizer can include a linear polarizer located between first and second quarter wave retarders. The light source is selectively energizeable to emit light through the transflector or partial mirror and the ambidextrous circular polarizer.

When ambient lighting conditions are poor, the liquid crystal display may operate as a transmissive display. Light is emitted from the back lighting source and is passed through the transflector or partial mirror. The light is then passed through the ambidextrous circular polarizer to polarize the light with the selected circular handedness. The chiral nematic liquid crystal material is controlled to selectively exhibit the planar texture and the focal conic texture. When the liquid crystal material exhibits the focal conic texture, the circularly polarized light is passed through the liquid crystal material to exhibit a bright state. When the liquid crystal material exhibits the planar texture the circularly polarized light is reflected back towards the back light by the liquid crystal material to create a dark state. The light reflected by the liquid crystal material exhibiting the planar texture is absorbed with the ambidextrous circular polarizer.

When ambient lighting conditions are sufficient, the liquid crystal display is operated as a reflective display. The chiral nematic liquid crystal material is controlled to selectively exhibit the planar texture and the focal conic texture. When the liquid crystal material exhibits the planar texture, a portion of the incident light is reflected by the chiral nematic liquid crystal material, creating a bright state. When the liquid crystal material exhibits the focal conic texture, incident light is passed through the liquid crystal material, creating a dark state. The light passed through the liquid crystal material is then passed through the ambidextrous circular polarizer to polarize the light with the selected circular handedness. The light passed through the ambidextrous circular polarizer is reflected by the reflective side of the transflector or partial mirror. The light reflected by the transflector is absorbed by the ambidextrous circular polarizer.

In the embodiment, the intensity of the ambient light is monitored. The light source is selectively energized and de-energized in response to the intensity of the ambient light.

Figure 13:
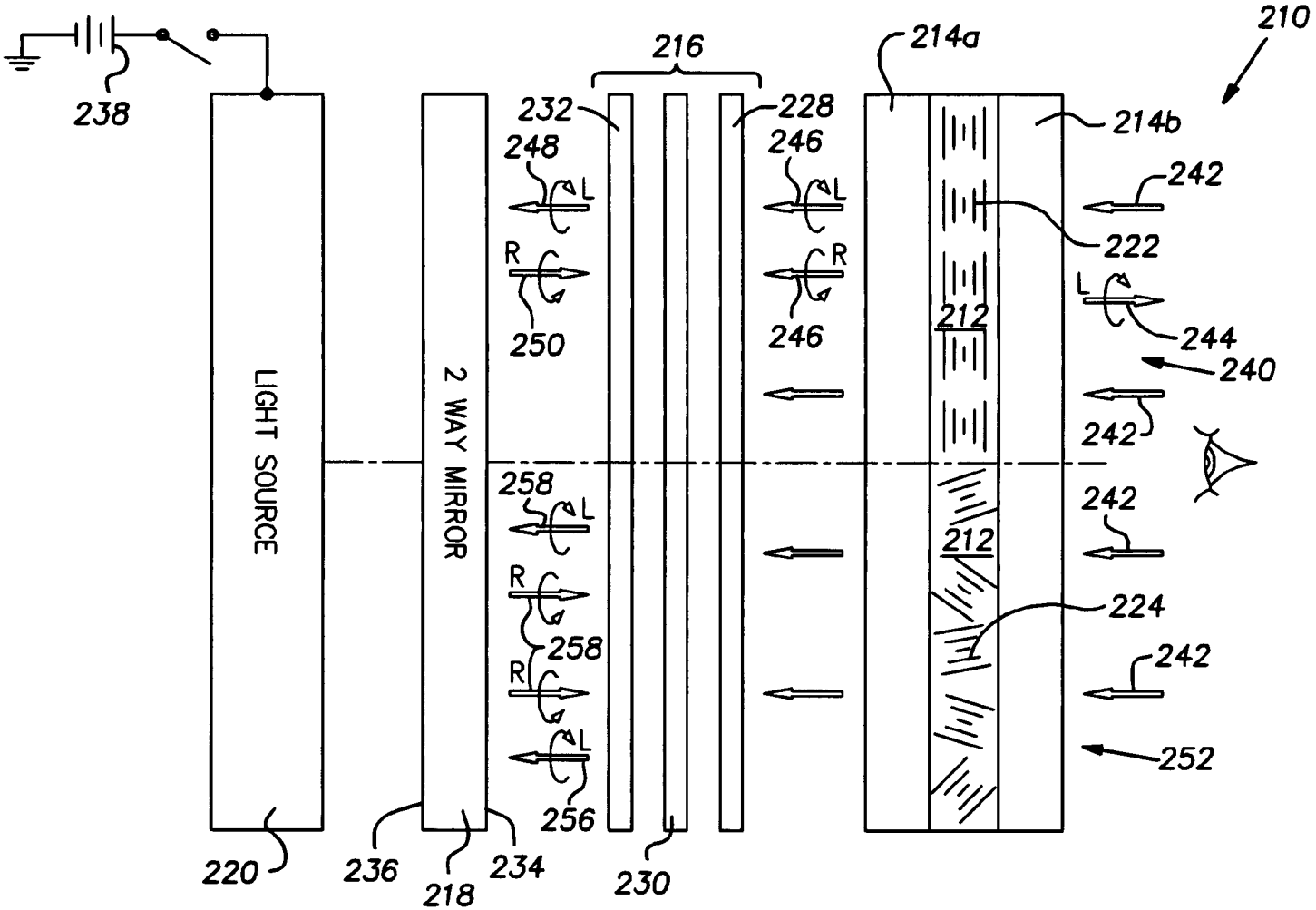
FIG. 13 is a schematic representation of a liquid crystal display operating in a reflective mode.
Figure 14:
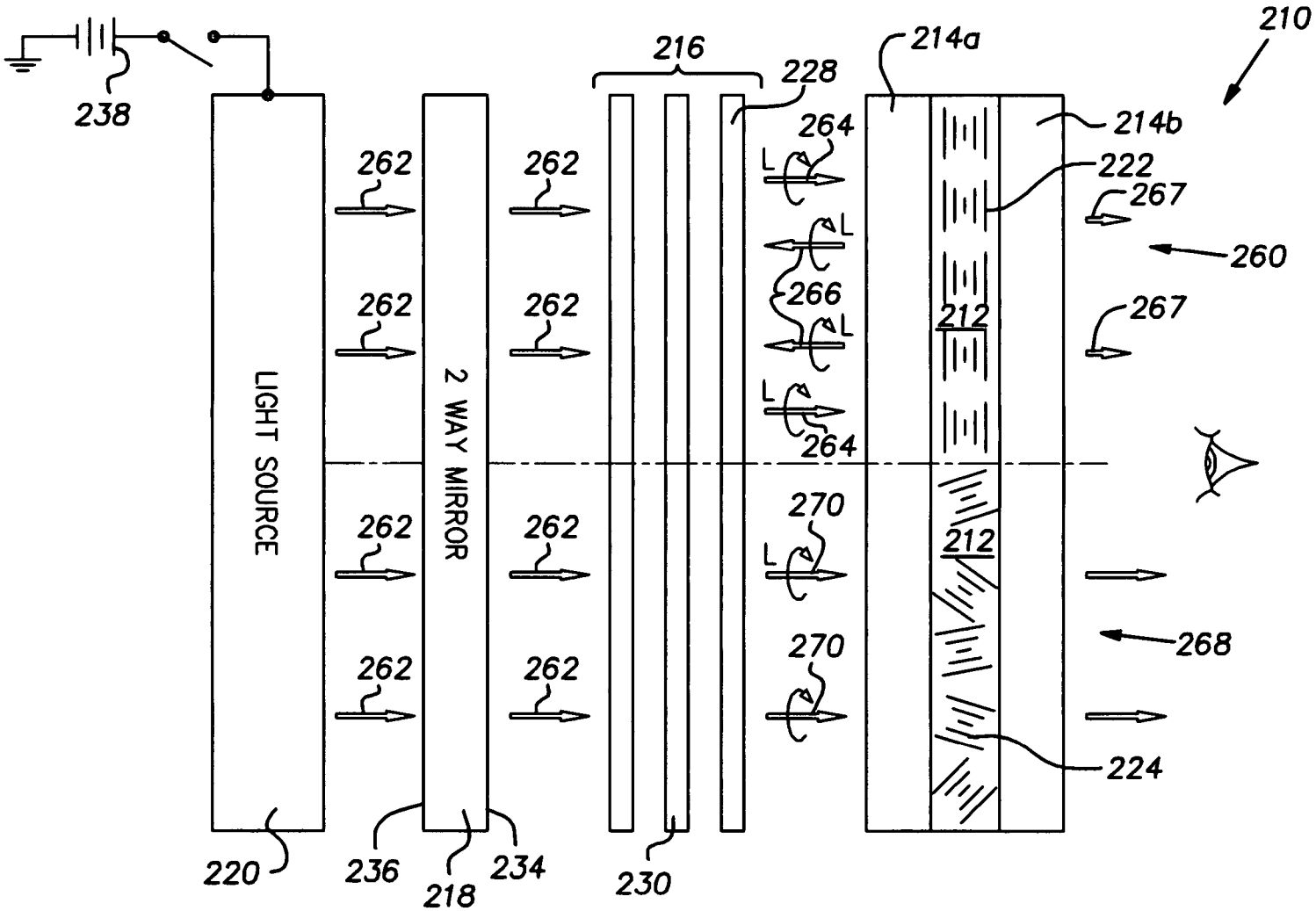
FIG. 14 is a schematic representation of a liquid crystal display operating in a transmissive mode.

Preferred embodiments of the backlit display are shown in FIGS. 13 and 14. The display utilizes a chiral nematic liquid crystal display 210 that may be operated in both a reflective mode and a transmissive mode. The liquid crystal display 210 includes a chiral nematic liquid crystal material 212 located between first and second substrates 214*a*, 214*b*, an ambidextrous circular polarizer 216, a partial mirror 218, also referred to as a transflector, and a light source 220.

In the embodiment, the chiral nematic liquid crystal material 212 is a bistable material that may be addressed in two states, the reflecting planar texture 222 and the weekly scattering focal conic texture 224. The focal conic and planar textures are stable in the absence of an electric field. In the illustrated embodiment, the liquid crystal material 212 is a left-handed chiral material. It should be apparent to those skilled in the art that a right-handed chiral material would work equally as well, with appropriate changes to other components of the display in view of this disclosure. In the illustrated embodiment, the planar texture has a left-handed circular polarization.

In the embodiment, one or more of the substrates 214*a*, 214*b* are rubbed to achieve a homogeneous alignment of the liquid crystal material 212 at the surface of the cell substrate. The liquid crystal material is a cholesteric material that exhibits a perfect planar texture and a focal-conic texture. The planar texture allows the display to exhibit high contrast and utilize the polarization state of light.

In the embodiment both substrates 214*a*, 214*b* of the cell are rubbed to create a perfect planar texture while maintaining the bistability of the cell. In one embodiment, a Nissan 7511 polyimide alignment layer is applied to both of the substrates and rubbed lightly to maintain the stability of the focal conic texture.

It should also be readily apparent to those skilled in the art that it may be suitable to rub only one substrate to create a bistable cell having planar textures and focal-conic textures that may be addressed.

In the embodiment, the rubbing is light, maintaining the stability of the focal-conic texture. Further details of one method of rubbing one or more of the substrates are outlined in the section styled "Rubbing Parameters" below. Further details of an appropriate method for rubbing the substrates is disclosed in U.S. patent application Ser. No. 09/378,380, entitled Brightness Enhancement For Bistable Cholesteric Displays, filed on Aug. 23, 1999, which is incorporated herein by reference, in its entirety.

In the embodiment, a voltage source momentarily is applied to the liquid crystal material 212 to create a field which causes the liquid crystal material to exhibit either the planar texture 222 or the focal conic texture 224. When the field is removed the liquid crystal material maintains the planar texture 222 or the focal conic texture 224. Details of an appropriate method for selectively causing the liquid crystal material 212 to exhibit the planar texture 222 and the focal conic texture 124 is described in U.S. Pat. No. 5,453,863 to West, issued Sep. 26, 1995, which is incorporated herein by reference.

In the embodiment, the ambidextrous circular polarizer 216 is located adjacent to one of the substrates 214*a*, 214*b* that bound the liquid crystal material 212. In the illustrated embodiment, the ambidextrous circular polarizer is a left-handed circular polarizer, corresponding to the left handed circular polarization of the planar texture. However, it should be readily apparent to those skilled in the art that a right-handed ambidextrous circular polarizer will work equally as well in combination with liquid crystal material that exhibits a planar texture having a right handed circular polarization. In the embodiment, the ambidextrous circular polarizer 216 includes a first quarter wave retarder 228, a second quarter wave retarder 232 and a linear polarizer 230 located between the two quarter wave retarders. One acceptable ambidextrous circular polarizer 216 has the same handedness as the twist sense of the cholesteric display. This type of polarizer is available from conventional polarizer suppliers, such as Nitto Dee or Polaroid.

In one embodiment, the partial mirror 218 or transflector has a reflective side 234 adjacent to the ambidextrous circular polarizer 216 and a light transmitting side 236 adjacent to the light source 220. The transflector 218 may have one side AR coated and the other side highly reflective, or it may be dielectrically stacked to achieve reflectiveness from one side of the transflector and transmissiveness from the other side of the transflector. Any mirror that transmits light from one direction and reflects light from the other direction is suitable.

In the embodiment, the transflector 218 is a polarization preserving transflector having 20% reflection and 80% transmission. A transflector having 20% reflection and 80% transmission reflects approximately 20% of the incident light and transmits approximately 80% of the incident light through the transflector. In one embodiment, the transflector reflects and transmits the same percentages of light incident on each side of the transflector.

Two suitable sources of transflectors are Astra Products and Seiko Precision. Printable transflective films are available from Seiko Precision. LCD polarizer manufactures also supply transflectors as part of a polarizer, known as transflective polarizers. In one embodiment, the transflector is combined with the ambidextrous circular polarizer.

The light source 220 is selectively connected to a voltage source 238 to selectively emit light through the transflector 218. The voltage source can be an AC or a DC voltage source. An acceptable light source 220 is a thin backlight such as one used in small LCD's (electroluminescent) having an emission spectrum within a narrow wavelength range corresponding to that of the reflective cholesteric display.

FIG. 13 illustrates operation of the chiral nematic liquid crystal display being operated in a reflective mode. The top half 240 of FIG. 13 illustrates the bright state of the reflective mode. The chiral nematic liquid crystal material 212 is controlled to selectively exhibit the planar texture 222. Ambient light 242 is incident on the liquid crystal material 212. When the liquid crystal material 212 exhibits the planar texture 222 approximately 50% of the light, for example, is reflected by the liquid crystal material. The light 244 reflected by the liquid crystal material is mostly left circularly polarized. The remainder of the incident light 242 is transmitted through the liquid crystal material. The transmitted light 246 has both left-handed and right-handed components. In the illustrated embodiment, the first quarter wave retarder 228 changes the light 246 to two orthogonal linear polarization states. The two polarization states are either lined-up with a transmission axis of the polarizer or they are perpendicular to it. The components which are perpendicular to the transmission axis of the polarizer are canceled at the linear polarizer 230, while the parallel components go through the polarizer and are left circularly polarized. The left circularly polarized light 248 is reflected by the reflective side 234 of the transflector 218. Reflection by the transflector 218 changes the light 246 to right circularly polarized light 250 that gets canceled out by the second quarter wave retarder 232 and the linear polarizer 230.

The net result is that substantially all of the light 246 transmitted through the liquid crystal material 212 is absorbed.

The lower half 252 of FIG. 13 illustrates the dark state of the liquid crystal display 210 being operated in a reflective mode. In the dark state, the liquid crystal material 212 is controlled to exhibit the focal conic texture 224. Ambient light 242 is transmitted through the liquid crystal in an unpolarized manner. The transmitted light 254 is left circularly polarized by the ambidextrous circular polarizer 216. The left circularly polarized light 256 is reflected by the transflector 218 turning it into right circularly polarized light 258. The right circularly polarized light 258 is absorbed by the left handed ambidextrous polarizer 216. Thus, substantially all the light transmitted through the liquid material 212 is absorbed, resulting in a dark state. This effectively serves as a back coating (e.g., black) for the display.

FIG. 14 illustrates the liquid crystal display being operated in a transmissive or back-lit mode. The upper half 260 of FIG. 14 illustrates the dark state of the liquid crystal display 210 operating in a transmissive mode. Unpolarized, collimated light 262 is emitted by the light source 220 and is transmitted through the transflector 218. The light 262 passes through the ambidextrous circular polarizer 216 and becomes left circularly polarized. The liquid crystal material 212 is controlled to exhibit the planar texture 222. The left circularly polarized light 264 is reflected by the liquid crystal. Since there are no 210 right-handed components, light transmission through the planar texture 222 is minimal. In the illustrated embodiment, the reflected light 266 is left circularly polarized and changes to linear polarization due to the quarter wave retarder. The state of polarization of the light 266 is perpendicular to the transmission axis of the polarizer and, therefore, gets absorbed by the polarizer. There is some light leakage 267 from the display, due to the fact that the planar texture only has a peak reflectance of approximately 50%. To minimize light leakage 267 from the display, the spectrum of the back light is tuned to closely match the reflection spectrum of the display to improve contrast. In the embodiment, the display reflects approximately 50% of incident light (i.e. 100% of the light of a particular handedness of the narrow bandwidth emitted by the light source).

The bottom half 268 of FIG. 14 illustrates the bright state of the liquid crystal display 210 being operated in the transmissive mode. The light source 220 emits light 262 through the transflector 218. The light 262 is left circularly polarized by the ambidextrous circular polarizer 216. The chiral nematic liquid crystal material 212 is controlled to exhibit the focal conic texture 224. The left circularly polarized light 270 passes through the liquid crystal material 212. The net result is a bright state in which is transmitted through the focal conic texture.

In one embodiment, the disclosed backlighting scheme is used for a stacked display. In one embodiment, the stacked display is a monochrome 30 double stacked display. The scheme for the monochrome double stacked display works essentially the same way as the disclosed single layer display.

Both cells have a near perfect planar texture (S3>0.75). The near perfect planar texture can be achieved by rubbing both surfaces of both cholesteric display layers. In the embodiment, the cells have opposite handedness cholesteric materials. As a result, the handedness of the ambidextrous circular polarizer is arbitrary. In one embodiment, the top layer is partially rubbed or unrubbed. In one embodiment, the stacked display is a full color, triple stack display.

An example of a stacked display that may be modified in accordance with this embodiment is disclosed in U.S. patent application Ser. No. 09/378,830, filed on Aug. 23, 1999 entitled "Brightness Enhancement for Bistable Cholesteric Displays" and Ser. No. 09/329,587, filed on Jun. 10, 1999 entitled "Stacked Color Display Liquid Crystal Display Device," which are incorporated herein by reference in their entirety.

In one embodiment, a scattering layer or light control film is added on top of a cell of a display to improve viewing of the display. Acceptable scattering layers or light control films may be obtained from Optical Coating Laboratory, Inc. (OCLI is a JDI Uniphase company) or Nitto Denko.

The combination of the driver with the above described display provides a simple way to view reflective cholesteric displays under low ambient lights. The backlit or transmissive mode is used only when ambient light is insufficient to view the display, thereby reducing the power consumption. The display image is reversed between the front lit mode and the back lit mode. If reversal of the image is not desirable, the display can be addressed in the inverse when the back light is turned on. The liquid crystal display of the display achieves contrast in low ambient lighting conditions. In addition, it does not affect the contrast and viewing characteristics of the display under normal or bright ambient lighting conditions.

The driver can also be utilized with an LCD having enhanced brightness features, such as that discussed in U.S. Pat. No. 6,532,052, issued on Mar. 11, 2003, and incorporated herein by reference in its entirety.

The display of that disclosure is directed to chiral nematic liquid crystal displays which include a "homogeneous" alignment surface on one or both of the substrates (i.e., sides) of a cell. This surface tends to align the liquid crystal director adjacent thereto and provide the display with increased brightness, low focal conic reflectance and/or reflected light that has an increased degree of circular polarization. Aspects of the display include a display with one side treated; a display with both sides treated; orientations of a display with the untreated side located nearest to and farthest from a viewer; and a stacked display having a cell with at least one side treated, such as a stacked display in which a second (e.g., lower) cell has both sides treated and a first (e.g., upper) cell has only the side nearest the second cell treated. These different embodiments may be achieved through the use of various alignment techniques such as rubbed polyimide, UV alignment, selection of alignment material such as low or high pretilt, and combinations of the foregoing.

One embodiment of that display is directed to a liquid crystal display having at least one cell with at least one side treated so as to enhance brightness, comprising chiral nematic liquid crystal material having positive dielectric anisotropy. In all embodiments of the display, the liquid crystal material is preferably substantially free from polymer. Cell wall structure contains the liquid crystal material. At least one homogeneous alignment surface is effective to substantially homogeneously align the liquid crystal director adjacent thereto. At least one of the cell wall structure and each homogeneous alignment surface cooperates with the liquid crystal material so as to form focal conic and planar textures that are stable in the absence of a field. This homogeneous alignment surface is effective to increase brightness by at least 5% at a wavelength of peak reflection of the planar texture over the reflectance of the planar texture in the control display. More specifically, brightness may be increased by at least 15% and, more preferably, by at least 30%. A device is used for applying an electric field to transform the liquid crystal material to at least one of the focal conic and planar textures.

Another embodiment of that display is directed to a liquid crystal display device having a focal conic state of low reflectance, comprising the chiral nematic liquid crystal material, the cell wall structure and the device for applying the electric field described above. At least one homogeneous alignment surface is effective to align the liquid crystal director adjacent thereto. At least one of the cell wall structure and each homogeneous alignment surface cooperates with the liquid crystal material so as to form focal conic and planar textures that are stable in the absence of a field. This homogeneous alignment surface is effective to prevent reflectance by the focal conic texture from exceeding 10% of electromagnetic radiation incident on the display at a wavelength of peak reflection of the planar texture. More specifically, in this embodiment each homogeneous alignment surface may cooperate with the material so as to be effective in increasing brightness by at least 5% at a wavelength of peak reflection of the planar texture. More specifically, brightness may be increased by at least 15% and, more preferably, by at least 30%. In all embodiments of the display the inventive liquid crystal display device is characterized by a threshold voltage for multiplexing.

In both of the enhanced brightness and low focal conic reflectance embodiments, the cell wall structure may comprise opposing substrates. A homogeneous alignment surface in the form of a rubbed alignment layer may be disposed adjacent one of the substrates, an inhomogeneous alignment surface being located on the opposing substrate (i.e., a cell treated on one side). In another aspect, homogeneous alignment surfaces in the form of rubbed alignment layer materials are disposed on both substrates (i.e., a cell treated on both sides). The homogeneous alignment surface may be in the form of a rubbed alignment layer material such as polyimide in all aspects and embodiments of the display.

The liquid crystal material may be selected from the group consisting of various chiral nematic liquid crystal materials each having a pitch length effective to reflect a selected wavelength of electromagnetic radiation, such as at least one of visible and infrared radiation. The device for applying an electric field is effective to provide the liquid crystal material with stable gray scale states. In all embodiments in which only one substrate of a cell is treated, the untreated substrate may be either upstream or downstream of the homogeneous alignment surface relative to a direction of light incident to the display.

Another embodiment of the display relates to a liquid crystal display in which reflected light is to a significant degree circularly polarized, comprising the chiral nematic liquid crystal material, cell wall structure and device for applying the electric field discussed above. At least one homogeneous alignment surface is effective to align the liquid crystal director adjacent thereto. At least one of the cell wall structure and each homogeneous alignment surface cooperates with the liquid crystal material so as to form focal conic and planar textures that are stable in the absence of a field. This homogeneous alignment surface is effective to increase by at least 10% a peak degree of circular polarization of light reflected from the planar texture as compared to the control display.

More specifically, in the case of the display that reflects light exhibiting a significant degree of circular polarization, each homogeneous alignment surface cooperates with the material so as to be effective in increasing brightness by at least 5% at a wavelength of peak reflection of the planar texture as compared to the control display. More specifically, brightness may be increased by at least 15% and, more preferably, by at least 30%. This homogeneous alignment surface may comprise a rubbed alignment layer material disposed adjacent the cell wall structure. The display may include a cell with one side rubbed or both sides rubbed. The display may reflect a particular wavelength of electromagnetic radiation and is suitable for grey scale, as described above.

The display with the circular polarized light feature may include a circular polarizer adjacent the cell wall structure as in the case when both sides of the cell are rubbed. The homogeneous alignment surfaces cooperate with the material effective to enable use of a driving voltage that is not substantially greater than a driving voltage of the control display. This homogeneous alignment surface is characterized by a pretilt angle of greater than about 10 degrees as in the case of a display having opposing homogeneous alignment surfaces in one region.

Another embodiment of the display is directed to a stacked liquid crystal display device comprising first chiral nematic liquid crystal material and second chiral nematic liquid crystal material. Between opposing substrates are formed a first region comprising the first material and a second region comprising the second material. The first region is stacked relative to the second region. At least one homogeneous alignment surface is disposed in at least one of the first region and the second region adjacent one of the substrates so as to homogeneously align the liquid crystal director adjacent thereto. At least one of the substrates and each homogeneous alignment surface cooperates with the first material to form in the first region focal conic and planar textures that are stable in the absence of a field, and at least one of the substrates and each homogeneous alignment surface cooperates with the second material to form in the second region stable focal conic and planar textures. One of the substrates and a first homogeneous alignment surface cooperates with the material in the second region so as to be effective in preventing reflection by the focal conic texture in that region from exceeding 10% at a wavelength of peak reflection of the planar texture. A device applies an electric field to transform the first material and the second material to at least one of the focal conic and planar textures.

In particular, in this stacked display embodiment a substrate that opposes the first alignment surface may comprise a second homogeneous alignment surface. The second region with the first and second homogeneous alignment surfaces may be disposed downstream of the first region relative to a direction of incident light. A third homogeneous alignment surface may be disposed adjacent one of the substrates in the first region. One of the substrates that opposes the third homogeneous alignment surface in the first region has an inhomogeneous alignment surface. The display enables use of a driving voltage that is not substantially greater than a driving voltage for a corresponding cell in the control display.

In another aspect of the stacked display, one of the substrates that opposes the first homogeneous alignment surface in the second region has an inhomogeneous alignment surface. The first region may include only one homogeneous alignment surface with an opposing substrate with an inhomogeneous alignment surface. In all embodiments herein, each homogeneous alignment surface may comprise a rubbed alignment layer material, such as a rubbed polyimide alignment layer material. The pretilt angle of the homogeneous alignment surface in such a cell may be greater than about 10.degree.

The stacked display for enhanced brightness may include a first material that has a chirality of an opposite twist sense than a chirality of the second material. At least one of the first and second liquid crystal materials may be selected from the group consisting of various chiral nematic liquid crystal materials each having a pitch length effective to reflect a selected wavelength of electromagnetic radiation such as at least one of visible and infrared radiation. The device for applying an electric field can cause the first and second liquid crystal material to assume stable grey scale states.

Another embodiment of a stacked display for enhanced brightness consists of a stacked display assembly in which the materials in both cells of the display have the same helical twist sense. Both materials may reflect at the same wavelength. In this case, enhanced brightness is achieved by sandwiching a half wave plate between the two cells. The purpose of the half wave plate is to change the handedness of the circularly polarized light.

Another embodiment is a double stacked system where a circular polarizer is sandwiched between the two cells. The use of homogeneously aligned surfaces may be similarly applied to triple or multiple stacked systems to increase the brightness or degree of circular polarization, and/or decrease focal conic reflectance, of full color or multicolor/infrared combinations. At least one of the inventive homogeneous alignment surfaces may be applied in one, two or more cells of double, triple and multiple cell stacked displays. Likewise, a circular polarizer may be inserted in the stack, as would be apparent to those skilled in the art in view of this disclosure.

In the stacked display, the first homogeneous alignment surface may cooperate with the second material so as to be effective in increasing brightness by at least 5% and, in particular, by at least 15% or 30%, at a wavelength of peak reflection of the planar texture in the second region, as well as increase by at least 10% a peak degree of circular polarization of light reflected from the planar texture in the second region. The above increases in brightness and degree of polarization may be observed in any of the stacked cells which employs at least one inventive homogeneous alignment surface.

Another embodiment of the display is directed to a liquid crystal display including a cell in which both sides are treated, comprising the chiral nematic liquid crystal material, substrates between which the liquid crystal material is disposed and the device for applying an electric field discussed above. Homogeneous alignment surfaces are adapted to align the liquid crystal director adjacent both of the substrates. The homogeneous alignment surfaces may be characterized by a pretilt angle of greater than about 10 degrees and cooperate with the liquid crystal material to form focal conic and planar textures that are stable in the absence of a field.

More specifically, this display may benefit from the enhanced brightness increase of at least 5% and, in particular, at least 15% or 30%, at a wavelength of peak reflection of the planar texture. The homogeneous alignment surfaces are preferably formed of a rubbed alignment layer material. This display may benefit from the use of liquid crystal materials that can reflect selected wavelengths of electromagnetic radiation and is suitable for grey scale. The display may include a circular polarizer adjacent one of the substrates and use a driving voltage not greater than what is employed in the control display.

Thus, a cost-effective, beneficial display device results by combining the configurable driver disclosed herein with the displays described above. Such a display can be utilized for a number of applications.

Some key concepts of the various preferred embodiments include:

- A driver configurable for simultaneous row and column mode operation with outputs divided into more than one block.
- A driver configurable for simultaneous row and column mode operation with outputs individually configurable.
- Each output block can be configured independently for column/row mode and data shift direction.
- The driver can cost-effectively drive a display with a small number of rows at a high drive voltage of more than 25V.
- This multiple configuration driver concept can be also applied to other display drivers in consideration of cost reduction.
- This concept can be used for drivers with any package format, such as QFP package, TCP package, chip-on-board, chip-on-flex, and chip-on-glass.
- Utilizing this driver to drive various state-of-the-art displays to create a display device.

The invention has been described hereinabove using specific examples; however, it will be understood by those skilled in the art that various alternatives may be used and equivalents may be substituted for elements or steps described herein, without deviating from the scope of the invention. Modifications may be made to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A reflective full color liquid crystal display device comprising:

first chiral nematic liquid crystal material comprising liquid crystal having a pitch length effective to reflect visible light of a first color, second chiral nematic liquid crystal material comprising liquid crystal having a pitch length effective to reflect visible light of a second color, and third chiral nematic liquid crystal material comprising liquid crystal having a pitch length effective to reflect visible light of a third color;

substrates that form therebetween a first region in which said first material is disposed, a second region in which said second material is disposed and a third region in which said third material is disposed, wherein said first region, said second region and said third region are stacked relative to each other;

electrodes disposed on said substrates effective to apply an electric field to areas of said first region, said second region and said third region, corresponding to a plurality of columns and rows;

wherein said substrates cooperate with said first material, said second material and said third material to form in said first region, said second region and said third region, scattering focal conic and reflecting planar textures that are stable in the absence of an electric field;

wherein incident light travels in a direction sequentially through said first region, said second region and said third region, said first region being closest to a viewer, comprising a light absorbing back layer disposed downstream of said third region relative to said direction of incident light;

wherein the incident light is reflected by the planar textures of said first region, said second region and said third region such that reflected light leaving the display exhibits a color that is an additive mixing of combinations of said colors which are reflected from said planar textures, and said incident light passing through said first region, said second region and said third region is absorbed by said light absorbing back layer; and a display driver for applying an electric field for transforming at least a portion of the liquid crystal of at least one of said first material, said second material and said third material, to at least one of the focal conic and planar textures, said display driver comprising a single chip including:

a plurality of display outputs each for outputting a drive voltage to one of said rows or one of said columns, and a plurality of configuration bits each having a row/column setting, wherein each said configuration bit is exclusively associated with one or more of said plurality of display outputs such that said row/column setting of said configuration bit is used to configure all of said associated one or more display outputs for driving either said rows or said columns;

wherein a proportion of at least one of said first material, said second material and said third material exhibits a planar texture in the absence of an electric field and a proportion of the at least one of said first material, said second material and said third material exhibits a focal conic texture in the absence of an electric field, wherein said display driver provides an electric field pulse of sufficient amplitude and duration to change the proportions of the at least one of said first material, said second material and said third material in said planar and focal conic textures, whereby the intensity of light reflected may be selectively adjusted.

2. A reflective liquid crystal display device comprising:

first chiral nematic liquid crystal material comprising liquid crystal having a pitch length effective to reflect electromagnetic radiation of a first wavelength and second chiral nematic liquid crystal material comprising liquid crystal having a pitch length effective to reflect electromagnetic radiation of a second wavelength;

substrates that form therebetween a first region in which said first material is disposed and a second region in which said second material is disposed, wherein said first region and said second region are stacked relative to each other;

electrodes disposed on said substrates effective to apply an electric field to areas of said first region and said second region, corresponding to a plurality of columns and rows;

wherein said substrates cooperate with said first material and said second material to form in said first region and said second region, scattering focal conic and reflecting planar textures that are stable in the absence of an electric field;

wherein incident light travels in a direction sequentially through said first region and said second region, said first region being closest to a viewer, comprising a light absorbing back layer disposed downstream of said second region relative to said direction of incident light;

wherein the incident light is reflected by the planar textures of said first region and said second region such that reflected light leaving the display exhibits a wavelength that is an additive mixing of combinations of said wavelengths which are reflected from said planar textures, and said incident light passing through said first region and said second region is absorbed by said light absorbing back layer; and a display driver for applying an electric field for transforming at least a portion of said liquid crystal material of the liquid crystal of at least one of said first material and said second material, to at least one of the focal conic and planar textures, said display driver comprising a single chip including:

a plurality of display outputs each for outputting a drive voltage to one of said rows or one of said columns, and a plurality of configuration bits each having a row/column setting, wherein each said configuration bit is exclusively associated with one or more of said plurality of display outputs such that said row/column setting of said configuration bit is used to configure all of said associated one or more display outputs for driving either said rows or said columns;

wherein a proportion of at least one of said first material and said second material exhibits a planar texture in the absence of a field and a proportion of the at least one of said first material and said second material exhibits a focal conic texture in the absence of an electric field, wherein said display driver provides an electric field pulse of sufficient amplitude and duration to change the proportions of the at least one of said first material and said second material in said planar and focal conic textures, whereby the intensity of light reflected may be selectively adjusted.

3. The liquid crystal display device of claim 2, wherein the liquid crystal material of one of said first material and said second material has a pitch length effective to reflect visible light and the liquid crystal of the other of said first material and said second material has a pitch length effective to reflect infrared radiation.

4. The liquid crystal display device of claim 2, wherein the liquid crystal of said first material has a pitch length effective to reflect visible light of a first color and the liquid crystal of said second material has a pitch length effective to reflect visible light of a second color.

5. A chiral nematic liquid crystal display, comprising:

chiral nematic liquid crystal material located between first and second substrates, said material including a planar texture having a circular polarization of a predetermined handedness and a focal conic texture that are stable in an absence of an electric field;

electrodes disposed on said first and second substrates effective to apply an electric field to areas of said region corresponding to a plurality of columns and rows;

a first quarter wave retarder located adjacent to said first substrate;

a linear polarizer located adjacent to said first quarter wave retarder;

a second quarter wave retarder located adjacent to said linear polarizer;

a transflector having a reflective side adjacent to said second quarter wave retarder and a light transmitting side;

a light source adjacent to said transmitting side, said light source being selectively energizeable to emit light through said transflector; and a display driver for applying an electric field for transforming at least a portion of said liquid crystal material to at least one of the focal conic and planar textures, said display driver comprising a single chip including:

a plurality of display outputs each for outputting a drive voltage to one of said rows or one of said columns; and a plurality of configuration bits each having a row/column setting, wherein each said configuration bit is exclusively associated with one or more of said plurality of display outputs such that said row/column setting of said configuration bit is used to configure all of said associated one or more display outputs for driving either said rows or said columns.

6. A liquid crystal display device comprising:

chiral nematic liquid crystal material;

substrates that form therebetween a region in which said liquid crystal material is disposed;

at least one alignment surface that is effective to substantially homogeneously align the liquid crystal director adjacent thereto, wherein at least one of said substrates and each said alignment surface cooperates with said liquid crystal material so as to form focal conic and planar textures that are stable in the absence of an electric field, each said alignment surface being effective to provide at least one of the following:

(a) a brightness at a wavelength of peak reflection of said planar texture that is increased by at least 5% as compared to an identical liquid crystal device but with inhomogeneous alignment surfaces, (b) the focal conic texture with a reflectance that does not exceed 10% of electromagnetic radiation incident on the display device at a wavelength of peak reflection of the planar texture, and (c) a degree of circular polarization at a wavelength of peak reflection of the planar texture, which is increased by at least 10% as compared to an identical liquid crystal device but with inhomogeneous alignment surfaces; and a display driver for applying an electric field for transforming at least a portion of said liquid crystal material to at least one of the focal conic and planar textures, said display driver comprising a single chip including:

a plurality of display outputs each for outputting a drive voltage to one of said rows or one of said columns; and a plurality of configuration bits each having a row/column setting, wherein each said configuration bit is exclusively associated with one or more of said plurality of display outputs such that said row/column setting of said configuration bit is used to configure all of said associated one or more display outputs for driving either said rows or said columns.

7. The liquid crystal display device of claim 6, wherein each said alignment surface cooperates with said material so as to be effective in increasing brightness by at least 5% at a wavelength of peak reflection of said planar texture.

8. The liquid crystal display device of claim 6, wherein each said alignment surface is effective to provide the focal conic texture with a reflectance that does not exceed 10% of electromagnetic radiation incident on the display device at a wavelength of peak reflection of the planar texture.

9. The liquid crystal display device of claim 6, wherein each said alignment surface is effective in providing the degree of circular polarization at a wavelength of peak reflection of the planar texture, which is increased by at least 10% as compared to the identical liquid crystal device but with inhomogeneous alignment surfaces.

10. A display driver comprising:

a plurality of display outputs configured in a single package, each of said outputs being configurable for outputting a drive voltage to a row and also alternatively configurable for outputting a drive voltage to a column; and a plurality of configuration bits each having a row/column setting and each configuration bit being associated with one or more of said plurality of display outputs, wherein said row/column setting of each one of said configuration bits is used to configure all of said associated one or more display outputs for driving a row of the display when said row/column setting is set with a row setting or alternatively said configuration bit is used to configure all of said associated one or more display outputs for driving a column of the display when said row/column setting is set with a column setting.

11. The display driver of claim 10, wherein some number of said display outputs associated with one configuration bit can be configured to drive rows of the display and another number of said display outputs associated with another configuration bit can be configured to drive columns of the display independent of each other.

12. A display driver comprising a single chip including:

a plurality of display outputs each for outputting a drive voltage to a row or a column of a display; and a plurality of configuration bits each having a row/column setting, wherein each configuration bit is exclusively associated with one or more of said plurality of display outputs such that said row/column setting of said configuration bit is used to configure all of said associated one or more display outputs for driving either rows or columns of the display.

13. The display driver of claim 12, wherein some number of said display outputs associated with one configuration bit can be configured to drive rows of the display and another number of said display outputs associated with another configuration bit can be configured to drive columns of the display independent of each other.

14. The display driver of claim 12, wherein, when at least one display output is set to drive a row of the display, said drive voltage output by said display output is set independent of the total number of rows in the display.

15. The display driver of claim 12, wherein the display driver is adapted to drive a bistable liquid crystal display.

16. The display driver of claim 15, wherein said bistable liquid crystal display includes a chiral nematic liquid crystal material having a planar texture and a focal conic texture that are stable in the absence of an electric field.

17. The display driver of claim 12, wherein each display output is uniquely associated with one of the configuration bits.

18. A display driver comprising a single chip including:

a plurality of driver blocks, each of said plurality of driver blocks having:

a plurality of display outputs each for outputting a drive voltage to a row or column of a display; and a configuration bit having a row/column setting, wherein said driver block is configured to drive either rows or columns of the display according to said configuration bit row/column setting, and each of said plurality of display outputs of said driver block is thereby configured to input said drive voltage to either a row or a column of the display, respectively.

19. The display driver of claim 18, wherein some number of said plurality of driver blocks can be configured to drive rows of the display and another number of said plurality of driver blocks can be configured to drive columns of the display.

20. The display driver of claim 18, wherein, when at least one of said plurality of driver blocks is set to drive rows of the display, said drive voltage output by said display outputs of said at least one of said plurality of driver blocks is set independent of the total number of rows in the display.

21. The display driver of claim 18, wherein the display driver is adapted to drive a bistable liquid crystal display.

22. The display driver of claim 21, wherein said driver is adapted for driving a bistable liquid crystal display including a chiral nematic liquid crystal material having a planar texture and a focal conic texture that are stable in the absence of an electric field.

23. The display driver of claim 18, wherein each of said plurality of driver blocks can be set to drive either rows or columns independently of any other driver block setting.

24. A display driver comprising a single chip including:

a first driver block having:

a plurality of display outputs, each for outputting a drive voltage to either a row or a column of a display; and a configuration bit having a row/column setting for setting said first driver block to drive either rows or columns of the display, wherein all of said plurality of display outputs are set to drive either rows or columns of the display, respectively; and a second driver block having:

another plurality of display outputs, each for outputting a drive voltage to either a row or a column of the display; and another configuration bit having a row/column setting for setting said second driver block to drive either rows or columns of the display, wherein all of said another plurality of display outputs are set to drive either rows or columns of the display, respectively.

25. The display driver of claim 24, wherein said first and said second drive blocks can be set independently of each other to drive either rows or columns.

26. The display driver of claim 24, wherein, when at least one of said first and second driver blocks is set to drive rows of the display, said drive voltage output by said display outputs of said at least one of said first and second driver blocks is set independent of the total number of rows in the display.

27. The display driver of claim 24, wherein the display driver is adapted to drive a bistable liquid crystal display.

28. The display driver of claim 27, wherein said display driver is adapted for driving a bistable liquid crystal display including a chiral nematic liquid crystal material having a planar texture and a focal conic texture that are stable in the absence of an electric field.

29. A display driver for driving a bistable display, said display driver comprising a single chip including:

a plurality of driver blocks, each driver block:

a plurality of display outputs, each for outputting a voltage to a row or a column of a display; and a configuration bit having a row/column setting, wherein all of said plurality of display outputs of said driver block are set to drive either rows or columns of the display according to said configuration bit setting, wherein each of said plurality of driver blocks can be set independently to drive either rows or columns, and further wherein said driver is adapted to drive a bistable display.

30. The display driver of claim 29, wherein one of said driver blocks has a certain number of display outputs, and further wherein another of said output blocks has a different number of display outputs.

31. The display driver of claim 29, wherein said configuration bits are implemented by using memory storage.

32. The display driver of claim 29, wherein each of said configuration bits is an input lead to said display driver and further wherein said setting is set by providing a voltage and/or logic setting to said input lead.

33. The display driver of claim 29, further including a data bus input, wherein said row/column setting of said configuration bit is obtained from said data bus input.

34. The display driver of claim 29, wherein the voltage of a display output driving a row of the display driver is independent of the total number of rows in the display.

35. The display driver of claim 29, further including a cascade output and a cascade input for cascading multiple drive blocks and/or multiple display drivers together.

36. A display driver system comprising a plurality of display drivers as defined in claim 35 cascaded together, wherein said system drives the display.

37. The display driver of claim 29, wherein said display driver is adapted for driving a bistable display including a chiral nematic liquid crystal material having a planar texture and a focal conic texture that are stable in the absence of an electric field.

38. A display driver comprising a single chip including:

a plurality of driver blocks, each driver block having a corresponding plurality of display outputs, each of said plurality of display outputs being effective for outputting a voltage to a row or a column of a display; and a plurality of configuration bits equal to the number of said plurality of driver blocks, wherein each configuration bit has a row/column setting and is associated with a corresponding driver block, and further wherein, each driver block is set to drive either rows or columns according to said row/column setting, such that each of said corresponding plurality of display outputs of said driver block are all set for driving a row or a column, respectively, of the display.

39. A display driver for driving a display, said display driver comprising a single chip including:

a plurality of driver blocks, each driver block including:

a plurality of display outputs, each for outputting a voltage to a row or a column of a display;

a configuration bit having a row/column setting;

a cascade input; and a cascade output, wherein all of said plurality of display outputs of said driver block are set to drive either rows or columns of the display according to said configuration bit setting, wherein each of said plurality of driver blocks can be set independently to drive either rows or columns, and further wherein two or more of said plurality of driver blocks can be cascaded together for driving additional rows or columns of the display by connecting a cascade input of one of said two or more driver blocks to the cascade output of another of said two or more driver blocks.

40. The display driver of claim 39, wherein a first display driver can be cascaded with a second display driver by connecting the cascade input of one of a plurality of blocks of the second display driver with the cascade output of one of a plurality of blocks of the first display driver for driving additional rows or columns of the display.

41. A display driver comprising a single chip including:

a plurality of display outputs each for outputting a drive voltage to a row or a column of a display;

a configuration bit having a row/column setting;

a cascade input; and a cascade output, wherein the row/column setting of said configuration bit is used to configure one or more display outputs for driving either a row or a column of the display, and further wherein a first display driver can be cascaded with a second display driver by connecting the cascade output of the first display driver with the cascade input of the second display driver for driving additional rows or columns of the display.

42. A liquid crystal display device comprising:

chiral nematic liquid crystal material;

substrates that form therebetween a region in which said liquid crystal material is disposed, wherein said substrates cooperate with said liquid crystal material to form in said region scattering focal conic and reflecting planar textures that are stable in the absence of an electric field;

electrodes disposed on said substrates effective to apply an electric field to areas of said region corresponding to a plurality of columns and rows;

wherein incident light travels in a direction through said region, comprising a light absorbing back layer disposed downstream of said region relative to said direction of incident light; and a display driver for applying an electric field for transforming at least a portion of said liquid crystal material to at least one of the focal conic and planar textures, said display driver comprising a single chip including:

a plurality of display outputs each for outputting a drive voltage to one of said rows or one of said columns; and a plurality of configuration bits each having a row/column setting;

wherein each said configuration bit is exclusively associated with one or more of said plurality of display outputs such that said row/column setting of said configuration bit is used to configure all of said associated one or more display outputs for driving either said rows or said columns.

43. The liquid crystal display device of claim 42, wherein some number of said display outputs associated with one said configuration bit can be configured to said rows and another number of said display outputs associated with another said configuration bit can be configured to drive said columns independent of each other.

44. The liquid crystal display device of claim 42, wherein, when at least one of said display outputs is set to drive one said row, said drive voltage output by the at least one said display output is set independent of the total number of said rows in the display.

* * * * *